US011866939B2

(12) United States Patent
Mullaney et al.

(10) Patent No.: US 11,866,939 B2
(45) Date of Patent: Jan. 9, 2024

(54) SUPPORT MODULE FOR A STRUCTURE

(71) Applicant: InQuik IP Holdings Pty Ltd, Penrith (AU)

(72) Inventors: Nicholas Bruce Mullaney, Marulan (AU); James Richard Howell, Clarence Town (AU)

(73) Assignee: InQuik IP Holdings Pty Ltd, Penrith (AU)

( * ) Notice: Subject to any disclaimer, the term of this patent is extended or adjusted under 35 U.S.C. 154(b) by 0 days.

(21) Appl. No.: 16/469,698

(22) PCT Filed: Dec. 14, 2017

(86) PCT No.: PCT/AU2017/051387

§ 371 (c)(1),
(2) Date: Jun. 14, 2019

(87) PCT Pub. No.: WO2017/107230

PCT Pub. Date: Jun. 21, 2018

(65) Prior Publication Data

US 2020/0080311 A1 Mar. 12, 2020

(30) Foreign Application Priority Data

Dec. 14, 2016 (AU) ..... 2016905163

(51) Int. Cl.
*E04C 5/16* (2006.01)
*E04C 5/20* (2006.01)
(Continued)

(52) U.S. Cl.
CPC ..... *E04C 5/0604* (2013.01); *E04G 17/14* (2013.01); *E04C 5/166* (2013.01); *E04C 5/168* (2013.01); *E04C 5/20* (2013.01); *E04G 11/12* (2013.01)

(58) Field of Classification Search
CPC .. E04B 1/4178; E04B 1/41; E04B 2001/4192; E04B 2/845; E04B 2/8635;
(Continued)

(56) References Cited

U.S. PATENT DOCUMENTS 3,238,684 A * 3/1966 Wood ..... E04G 21/12 52/712
4,864,792 A * 9/1989 Andre ..... E04B 2/845 52/428

(Continued)

FOREIGN PATENT DOCUMENTS

CA 2258985 A1 * 7/2000 ..... E04B 2/8617
CH 549182 A5 5/1974

(Continued)

OTHER PUBLICATIONS

European Patent Office Extended Search Report for Application No. 17880158.5 dated Jul. 16, 2020 (7 pages).

(Continued)

*Primary Examiner* — Ryan D Kwiecinski
(74) *Attorney, Agent, or Firm* — Michael Best & Friedrich LLP

(57) ABSTRACT

A module for constructing foundations for a structure, comprising: a plurality of formwork members that define a pair of side walls that define a space between the side walls; thereto to hold the side walls in a spaced relationship; a three dimensional reinforcement cage that includes the brace, a plurality of first members, and a plurality of second members perpendicular to the first members, the first members coupled to at least the brace and the second members coupled to at least one of the plurality of the first members and the brace, wherein the cage forms an internal support within the space between the side walls for receiving a settable material, such that the side walls become integrated (Continued)

with the internal support as the settable substrate sets, to form the module.

14 Claims, 29 Drawing Sheets

(51) Int. Cl.
*E04G 11/12* (2006.01)
*E04G 17/14* (2006.01)
*E04G 5/06* (2006.01)
*E04C 5/06* (2006.01)

(58) Field of Classification Search
CPC ..... E04B 2/8617; E04B 2/8647; E04G 11/12; E04G 17/14; E04C 5/0604; E04C 5/166; E04C 5/168; E04C 5/20; E01D 19/02; E02D 27/42; E02D 29/025
USPC ..... 52/378, 379, 383, 712
See application file for complete search history.

(56) References Cited

U.S. PATENT DOCUMENTS 4,972,646 A * 11/1990 Miller ..... E04B 2/8647 52/426
5,809,725 A * 9/1998 Cretti ..... E04F 13/045 52/565
5,852,907 A * 12/1998 Tobin ..... E04B 2/8652 249/40
6,070,380 A 6/2000 Meilleur
6,691,486 B1 * 2/2004 Durand ..... E04C 5/064 52/645
6,898,912 B2 * 5/2005 Bravinski ..... E04C 5/20 52/565
7,882,672 B2 * 2/2011 Emblin ..... E04B 1/161 52/562
7,934,693 B2 * 5/2011 Bravinski ..... E04G 11/18 249/40
9,187,915 B2 * 11/2015 Jung ..... E04C 5/168
10,487,501 B2 * 11/2019 Howorth ..... B28B 7/303
10,794,053 B2 * 10/2020 Wu ..... E04B 1/41
2003/0192272 A1 * 10/2003 Bravinski ..... E04B 2/8647 52/309.11
2003/0213198 A1 * 11/2003 Bentley ..... E04B 2/8617 52/415
2004/0025463 A1 * 2/2004 Yauchi ..... E04B 2/8635 52/426
2004/0035073 A1 * 2/2004 Bravinski ..... E04C 5/203 52/426
2004/0237435 A1 * 12/2004 Yurkevich ..... E04C 3/34 52/378
2006/0037276 A1 * 2/2006 Sweeney ..... E04B 2/8617 52/712
2006/0117693 A1 * 6/2006 Garrett ..... E04C 1/40 52/426
2006/0179787 A1 * 8/2006 Bilowol ..... E04G 9/02 52/741.11
2007/0068105 A1 3/2007 Given
2008/0092471 A1 * 4/2008 Ahmad ..... F41H 5/0492 52/378
2008/0110118 A1 * 5/2008 Molina ..... E04G 11/10 52/379
2009/0249725 A1 * 10/2009 McDonagh ..... E04G 17/14 52/378
2011/0011022 A1 * 1/2011 Garrett ..... E04B 2/8617 52/582.1
2011/0099932 A1 * 5/2011 Saulce ..... E04C 5/18 52/745.13
2012/0167503 A1 * 7/2012 Suzuki ..... E02D 27/01 52/292
2013/0074432 A1 * 3/2013 Ciuperca ..... E04B 1/161 52/309.4
2013/0180192 A1 * 7/2013 Crosby ..... E04B 2/8635 52/426
2013/0312350 A1 * 11/2013 Kreizinger ..... E04G 11/00 52/426
2014/0157704 A1 * 6/2014 McDonagh ..... E04G 21/185 52/426
2016/0069063 A1 3/2016 Harvey
2016/0281355 A1 9/2016 McDonagh
2018/0112400 A1 * 4/2018 Dajnko ..... E04B 2/8635

FOREIGN PATENT DOCUMENTS

CN 102409606 A * 4/2012
DE 3422865 A * 1/1985 ..... E04C 5/168
DE 3628876 A * 3/1988 ..... E04B 2/8635
FR 2879634 A1 6/2006
GB 2113268 A * 8/1983 ..... E04B 1/14
JP 1985059256 A 4/1985
JP 1998299176 A 11/1998
JP H1136587 A 2/1999
KR 20050021771 A 3/2005
KR 1933829 B1 * 4/2019 ..... E04C 5/168
WO WO-0246545 A1 * 6/2002 ..... E02D 27/02
WO 2004113645 12/2004
WO WO-2005042864 A1 * 5/2005 ..... E04B 2/8635
WO WO-2013109058 A1 * 7/2013 ..... E04B 2/84
WO 2016183639 11/2016

OTHER PUBLICATIONS

International Search Report for Application No. PCT/AU2017/051387 dated Mar. 28, 2018 (English Translation, 3 pages).
Australian Patent Office Action for Related Application No. 2017377663 dated Jan. 19, 2023 (8 pages).

* cited by examiner

SUPPORT MODULE FOR A STRUCTURE

TECHNICAL FIELD

This invention relates to modules for constructing foundations for a structure such as bridges, roads and single or multi-storey buildings, and a method of constructing a foundation or footing from a plurality of modules and an abutment comprising a plurality of modules.

BACKGROUND

A problem with existing construction methods for precast concrete bridges and other structures is that precast concrete components are heavy, difficult to transport and can be damaged easily in transit.

Typically in situ construction methods are time consuming, expensive and require high levels of expert supervision.

There is a need to design improved foundations, such as abutments and support structures prior to installation of bridges, road and other building structures and methods for economical and efficient construction thereof.

SUMMARY OF THE INVENTION

In broad terms, the invention provides a module for constructing foundations for a structure, comprising: a plurality of formwork members that define a pair of side walls that define a space between the side walls; a brace that extends between the pair of side walls and is coupled thereto to hold the side walls in a spaced relationship; a three dimensional reinforcement cage that includes the brace, a plurality of first members, and a plurality of second members perpendicular to the first members, the first members coupled to at least the brace and the second members coupled to at least one of the plurality of the first members and the brace, wherein the cage forms an internal support within the space between the side walls for receiving a settable material, such that the side walls become integrated with the internal support as the settable substrate sets, to form the module. The foundation module may form part of a larger structure. The structure may be an abutment for a bridge or road way in which a plurality of foundation modules are simultaneously constructed and filled with concrete to thereby form the required abutment in situ.

The formwork may comprise a pair of end walls, to enclose the space between the side walls and form a cavity therebetween.

The brace, the first members and the second members of the cage may be mutually perpendicular.

The brace may releasably engage at least one of the pair of side walls. The brace may releasably engage each of the opposing side walls.

The plurality of first members may extend beyond the pair of side walls to engage successive modules. The plurality of second members may extend beyond the pair of side walls to engage adjacent structures.

The pair of side walls may include upper and lower engagement means for securing each of the side walls to at least one of the brace and a successive side wall. These side walls are axially aligned and create a first level of the foundation module.

The brace may provide resistance to the side walls against the force of the settable material being introduced into the space. One such force is the hydrostatic pressure exerted by the fluid concrete on the side walls due to the force of gravity. The hydrostatic pressure increases in proportion to depth from the surface, as each level of foundation module is constructed, because of the increasing weight of fluid concrete exerting downwards force from above. The forces within the concrete act across each flat plane of the module and are in equilibrium within the foundation module. The brace may comprise locating means for receiving and securing a first member of the reinforcement cage thereto. The brace may comprise locating means for receiving and securing a plurality of first members of the reinforcement cage thereto. The brace may be welded to at least one of the plurality of second members and the plurality of first members.

The locating means may comprise at least one aperture for threadingly receiving the first member. The locating means may comprise at least one open slot or recess within the brace for slidingly receiving the first member.

The brace may comprise engagement means for cooperating with engagement means of the side walls. The engagement means may comprise a pair of elongate protrusions configured to be received by the cooperating engagement means of the side walls. The cooperating engagement means of the side walls may comprise a series of shaped apertures for receiving the elongate protrusions therein. The elongate protrusions of the brace may be held in cooperation with the shaped apertures of the side walls by gravitational force.

The at least one of the plurality of second members may be welded to at least one of the plurality of first members to form the reinforcement cage. Each of the plurality of second members may be welded to at least one of the plurality of first members.

The brace may be mechanically fastened to each of the pair of side walls. The brace may provide a mechanical attachment at opposing ends thereof.

The pair of side walls may be configured as C-sections. The pair of side walls may each provide an upper and a lower attachment surface. The upper and lower attachment surfaces of each pair of side walls may be symmetrical. The upper and lower attachment surfaces of each pair of side walls may be non-symmetrical. The upper and lower attachment surfaces of each pair of side walls may extend from the side wall at 90 degrees. The upper and lower attachment surfaces of each pair of side walls may extend from the side wall at an angle less than 90 degrees therefrom. The upper and a lower attachment surfaces may each provide a plurality of apertures for receiving the brace or a successive side wall.

Each of the pair of side walls may be of equal length. Each of the pair of side walls may be of differing lengths.

The module may comprise a plurality of supplemental reinforcing members spaced between the pair of side walls and extending along the length of the module. The supplemental reinforcing members may be located towards an outer periphery of the space.

The module may further comprise a pair of end plates configured to form a peripheral formwork with the pair of side walls, housing the brace and the reinforcement cage within the space.

The module may further comprise a base extending between and coupled with a lower portion of each of the pair of side walls. The base may be flat. The base may be configured with a recess thereby reducing a volume of the space between the side walls.

The foundation module of the invention, when used in abutment construction, reduces, if not resolves, some of the limitations encountered currently in abutment construction. The modular abutment construction of the invention further provides a fast and easy-to-install abutment for supporting a bridge or alternative structure.

The applications of the foundation modules of the invention assist in constructing abutments for building new or replacing old bridges, by providing a pre-engineered product equally suitable for use in both highly regulated markets and emerging markets. The foundation modules further provide a sturdy support base for emergency housing.

The invention further provides a structure that includes the foundation module defined herein as part of the structure. The structure may be a bridge, with the foundation module being formable simultaneously with a portion of the bridge. The structure may be a single or multi-storey building, with the foundation module forming at least part of a floor or a foundation of the building.

The reinforcement cage is constructed in such a way as to structurally support the side walls. The settable material is introduced around the reinforcement cage and braces, and once set, cures to form a robust reinforced structure. The settable material may be concrete or cement.

The side wall may have C-sections. The side walls may provide at least one of an upper or lower attachment surface or flange.

The upper and lower attachment surfaces may comprise a plurality of apertures. These apertures may be specifically dimensioned to receive mounting bolts or other mechanical mount means. Additionally, these apertures may improve flow of the settable material around the space. Furthermore, the aperture may reduce weight and material usage in production of the side walls.

Further uses of the modular construction of the invention are in constructing building foundations where floor slabs and support beams may be combined with foundation modules of the invention to form a single support structure and, accordingly, the modules can be incorporated into the overall reinforced building structure.

The foundation modules may be coupled with additional structural elements to provide a bridge superstructure, headstocks, piers, rail systems, overpasses and roads.

The reinforcement cage comprises three primary elements: a plurality of first members, a plurality of second members and the brace.

The plurality of first members and the plurality of second members are typically situated within the space at right angles to one another or perpendicular to one another.

The plurality of first members and the plurality of second members of the reinforcement member can be of similar dimensions and as such, may be easily mass-produced in volume.

In one embodiment, the invention provides an abutment comprising a first foundation module and at least one successive foundation module, with the first foundation module comprising: a plurality of formwork members that define a pair of side walls such that the side walls define a space between the side walls; a brace that extends between the pair of side walls and is coupled thereto to hold the side walls in a spaced relationship; a three dimensional reinforcement cage that includes the brace, a plurality of first members, and a plurality of second members perpendicular to the first members, the first members coupled to at least the brace and the second members coupled to at least one of the plurality of the first members and the brace, with the or each successive foundation module comprising: a plurality of formwork members that define a pair of side walls such that the side walls define a space between the side walls; a brace that extends between the pair of side walls and is coupled thereto to hold the side walls in a spaced relationship; a three dimensional reinforcement cage that includes the brace and a plurality of second members, wherein the plurality of first members of the first foundation module extend beyond the pair of side walls of that module and engage the brace of the or each successive module and thereby locate the or each successive module, wherein the reinforcement cages form an internal support within the space between the side walls for receiving a settable material, such that the side walls become integrated with the internal support as the settable material sets, to consolidate the foundation modules to form the abutment.

The abutment can be assembled from its constituent parts without the concrete, which is introduced to the space only after the side walls, brace and reinforcement cage are connected together.

The abutment may comprise a plurality of successive foundation modules. Each successive foundation module may be formed in parallel, upright alignment with the first foundation module.

The abutment may further comprise a pair of end plates defining a peripheral formwork with the pair of side walls bounding a cavity housing the internal support therein.

The brace may provide means for mechanical attachment at opposing ends thereof. The brace of the successive module may be coupled with the pair of side walls of the first foundation module, thereby increasing a volume of the space of the first foundation module.

Each of the opposing ends of the brace is mechanically attached to both a side wall of the first module and a sidewall of the successive module to retain two adjacent foundation modules in alignment within the abutment.

The internal support may further comprise additional reinforcement in the form of X-braces. The internal support may be reinforced with ligatures. The ligatures may encircle the reinforcement cage either horizontally or vertically within the space between the side walls. The ligatures may encircle the inner support of the abutment within the space between the side walls of both the first module and the successive module.

The invention also provides a structure that includes the abutment defined herein as part of the structure. The structure may be a bridge, with the abutment being formable simultaneously with a portion of the bridge. The structure may be a single or multi-storey building, with the abutment forming at least part of a floor or a foundation of the building.

The first reinforcement members may be vertical reinforcement members and the second reinforcement members may be horizontal reinforcement members. When combined with the brace, the vertical reinforcement members and the horizontal reinforcement members form the reinforcement cage. Each of the three components, the brace, the vertical reinforcement members and the horizontal reinforcement members are mutually perpendicular.

A further benefit of the invention is the ability for successive foundation modules to receive an extended first member or an extended second member from an adjacent foundation module. These members interlink the adjacent modules in their respective directions such that a single concrete pour or alternative settable material will fill not a single space but multiple spaces across the adjacent modules, thereby setting and forming a single integrated abutment or bridge/abutment structure in one pour of the settable material.

The extended second or horizontal members may be overlapping bars that slide into position, extending between adjacent foundation modules. Once in position they can be welded, glued, bolted, screwed or otherwise secured to adjacent braces or first members within the space of the module/modules.

At least one of the formwork members and the reinforcement cage may be tensionable such that the finished module is pre-tensioned.

The formwork members may further comprise engagement members to interconnect with successive formwork members or alternative supporting structure.

The reinforcement cage may be partially immersed within the concrete of the finished module. Alternatively, a portion of the first members and/or the second members of the reinforcement cage may be left exposed and may thus partially extend from the concrete of the finished foundation module, to provide an engagement portion. The engagement portion may be used to engage the foundation module with successive foundation modules or building structures or bridge decks to which the foundation modules will be secured to. The reinforcement cage may be fully covered by the concrete within the space.

The reinforcement cage provides an internal support that acts as a structural skeleton, integrated within the settable material of the module.

At least one of the braces within the abutment may be pre-tensioned.

The settable material e.g. concrete or cement may be introduced into the space in more than one pour. A first concrete pour may be introduced to fill a foundation module, or partially fill a foundation module. The first pour is allowed to cure before a successive pour is introduced. This first pour, once set, may be sufficient to allow the partially complete abutment to be more easily manoeuvred around a site before being situated in the final location. Once in position a second pour of settable material will fill the space. The second pour may be the same settable material as the first pour. Alternatively a second pour of settable material may constitute a different material for example a rubber, a plastic or other material with improved damping characteristics. The space may be filled on the second pour or only partially filled to allow the damped material to set as a layer within the abutment. A third pour of an alternative material of the first material may then be introduced to fill the space. Once all three layers have set, the abutment will have a natural damping layer within that may improve performance of the abutment. This damping layer may also provide a level of flexibility to enable the structure supported by the abutment to better withstand damage from heavy load or even earthquake forces.

The side walls of the abutment may stop short of the dimensions of the first or second members to cooperate with or receive reinforcements and support members from cooperating structures.

The first and second members may further be configured to extend above the side walls, such that the protruding members provide a side rail, a hand rail truss, or a safety barrier to the finished abutment or foundation module.

The invention also provides a method of constructing a foundation module, the method comprising the steps of: (i) coupling a pair of side walls to a brace, to hold the side walls in spaced apart relationship forming a space therebetween; (ii) constructing a three dimensional reinforcement cage by positioning a pair of first members perpendicular to the brace within the space and securing the first members to the brace, and positioning a pair of second members within the space parallel to the pair of side walls, wherein the cage forms an internal support within the space between the side walls; and (iii) introducing a settable material into the space to integrate the internal support with the side walls as the settable material sets, to form the foundation module.

The method may comprise an additional step of coupling a successive brace to each of the side walls. The method may comprise an additional step of securing the first members to at least one of the brace or the second members.

The method may comprise an additional step of coupling the brace to each of the pair of side walls. The method may mechanically couple the brace to each of the pair of side walls. The method may comprise an additional step of bolting the brace to each of the pair of side walls.

The method may comprise an additional step of slidingly receiving the first members through corresponding apertures within the brace. The method may weld the brace to the first reinforcement members.

The brace of the combined structure may be made-up by the strength of the welds between the first and second members.

The invention also provides a method of constructing an abutment using a plurality of foundation modules, the method comprising the steps of: (i) coupling a pair of side walls to a brace, to hold the side walls in spaced apart relationship forming a space therebetween; (ii) constructing a three dimensional reinforcement cage by: (a) positioning a pair of first members perpendicular to the brace within the space and securing the first members to the brace, wherein the first members extend beyond the pair of side walls, and (b) positioning a pair of second members within the space parallel to the pair of side walls, (iii) coupling a successive pair of side walls to the side walls and engaging the successive side walls with a successive brace; (iv) coupling the successive brace to the first members of the reinforcement cage; (v) positioning a successive pair of second members within the space parallel to the successive side walls, such that the cage forms an internal support within the space between the side walls and successive side walls; and (vi) introducing a settable material into the space to integrate the internal support with the side walls and successive side walls as the settable material sets, to form the abutment.

The method may further comprise an additional step of coupling supplementary reinforcement members to the reinforcement cage of the abutment that extend at least one of horizontally or vertically beyond the abutment, prior to introducing the settable material of step (vi).

The invention additionally relates to a foundation module and bridge deck that may be constructed in situ to form a single space therebetween for receiving a settable substrate, such that a single pour of the settable material will result in the bridge deck and the foundation module being combined into a single, integrated structure as the settable material sets.

A bridge can be constructed in accordance with the invention by positioning one or more foundation modules side by side to receive an end portion of a bridge or bridge deck. More particularly the foundation modules may be arranged side by side or one on top of the next and interconnect such that there is no break between successive foundation modules or the bridge deck. This allows the concrete or alternative settable material, to flow freely across successive foundation modules and the bridge deck. This creates a homogeneous structure which offers improved resistance to the inertia forces caused by vehicles traversing the finished bridge.

The invention also provides a method of constructing a foundation module and a bridge contemporaneously, the method comprising the steps of: (i) coupling a pair of side walls to a brace, to hold the side walls in spaced apart relationship forming a space therebetween; (ii) constructing a three dimensional reinforcement cage by positioning a pair of first members perpendicular to the brace within the space and securing the first members to the brace, and positioning a pair of second members within the space parallel to the pair of side walls, wherein the cage forms an internal support within the space between the side walls; (iii) supporting a portion of a bridge upon the three dimensional cage, the bridge comprising a tray defining a cavity, including a reinforcement truss situated within the cavity, such that the cavity is in fluid communication with the space; and (iv) introducing a settable material into both of the space and the cavity to simultaneously integrate the internal support with the side walls of the foundation module and integrate the truss with the tray of the bridge as the settable material sets, to form a unitary foundation module and bridge structure.

The method may further comprise an additional step of coupling supplementary reinforcement members between the reinforcement truss of the bridge and the reinforcement cage of the abutment, prior to introducing the settable material of step (iv).

The term "abutment" is understood herein to include a sub-structure built to support the lateral pressure of an arch or a span, as employed at the ends of a bridge, an elevated road section, or a building structure. The structure itself will contact and rest upon the abutment. Abutments may provide both vertical and lateral support for the structure thereon as well as providing a retaining wall to resist earth movement at the approach to a structure. Abutments may be positioned at opposing ends of a structure, for example a bridge, or may be positioned on opposing sides of a structure, for example when supporting a dam across a valley.

The terms "foundation" is understood herein to refer broadly to the elements of an architectural structure that connect it to the ground and transfer loads from the structure into the ground. A "foundation" may also be referred to as a footing or footings of a structure.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention are illustrated by way of example, and not by way of limitation, with reference to the accompanying drawings, of which.

DETAILED DESCRIPTION OF EMBODIMENTS

The invention will now be described more fully hereinafter with reference to the accompanying drawings, in which various embodiments, although not the only possible embodiments, of the invention are shown. The invention may be embodied in many different forms and should not be construed as being limited to the embodiments described below.

Figure 2:
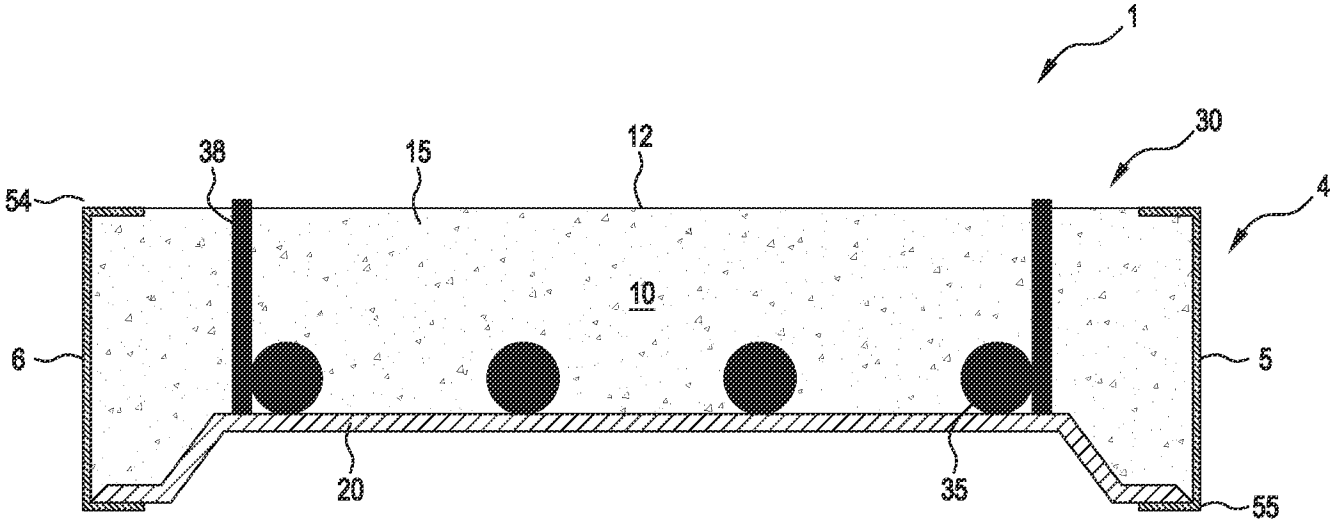
FIG. 2 is a cross-sectional representation of a foundation module according to one embodiment of the invention.

While the invention is described hereafter in relation to an abutment for supporting a bridge, the invention is applicable to other structures, including but not limited to other forms of infrastructure for example: footpaths, roads, road sound panels, short and long span bridges, bridge decks, road and rail tunnels, buildings and high-rise blocks. With particular reference to FIG. 2, there is illustrated an embodiment of a module 1 for constructing foundations for a structure 110, comprising: a plurality of formwork members 4 that define a pair of side walls 5, 6 that define a space 10 between the side walls 5, 6; a brace 20 that extends between the pair of side walls 5, 6 and is coupled thereto to hold the side walls 5, 6 in a spaced relationship; a three dimensional reinforcement cage 30 that includes the brace 20, a plurality of first members 38, and a plurality of second members 35 perpendicular to the first members 38, the first members 38 coupled to at least the brace 20 and the second members 35 coupled to at least one of the plurality of the first members 38 and the brace 20, wherein the cage 30 forms an internal support 40 within the space 10 between the side walls 5, 6 for receiving a settable material 15, such that the side walls 5, 6 become integrated with the internal support 40 as the settable material 15 sets, to form the module 1.

In a first embodiment, as illustrated in FIG. 2, the first members 38 are illustrated as vertical reinforcement members 38. In FIG. 2, the second members 35 are illustrated as horizontal reinforcement members 35. The cage 30 thus provides support in six degrees of freedom as the brace 20, the vertical reinforcement members 38 and the horizontal reinforcement members 35 are all mutually perpendicular.

Figure 1:
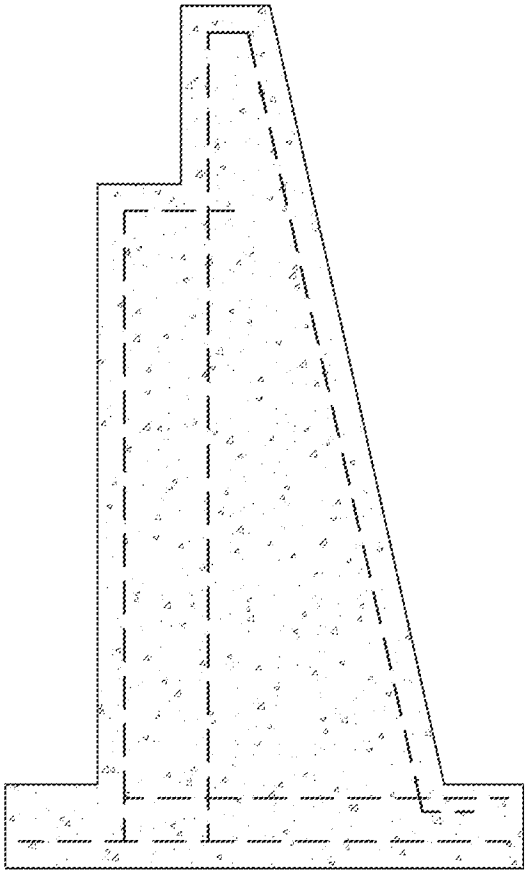
Figure 1 Prior Art
FIG. 1 is a cross-sectional view of a typical concrete abutment as known in the art.
Figure 1A:
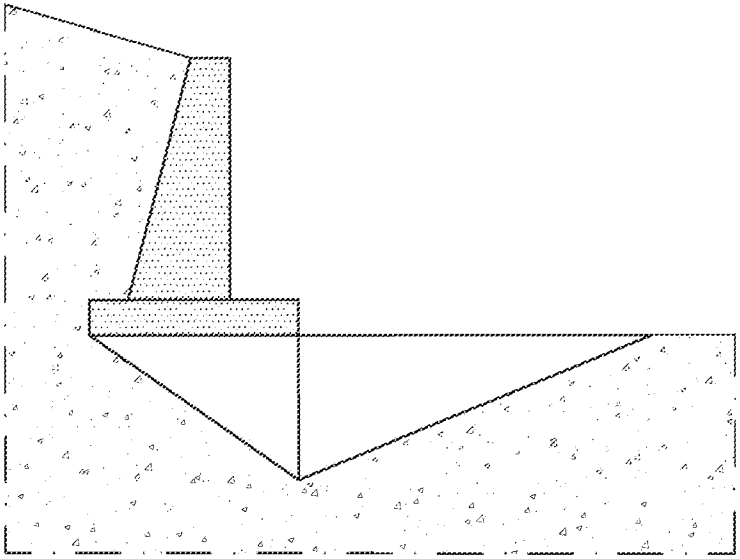
FIG. 1A is a load diagram representing the direction of loads as reacted by the typical abutment of FIG. 1.

The components of the foundation module 1 can be easily transported in a flat or nested manner to be assembled on site or adjacent the intended location for use. Typical foundation panels and abutments are large and bulky concrete modules as illustrated in FIGS. 1 and 1A which are typical of known prior art. These known abutment panels are heavy and easily damaged during transport. The irregular geometry of a typical abutment is designed to react to loads on the abutment during use; however, this irregular geometric form makes them difficult to nest and thus costly and cumbersome to transport.

Figures 7, 7A, 7B, 7C, 7D, 7E, 7F, 7G, 7H:
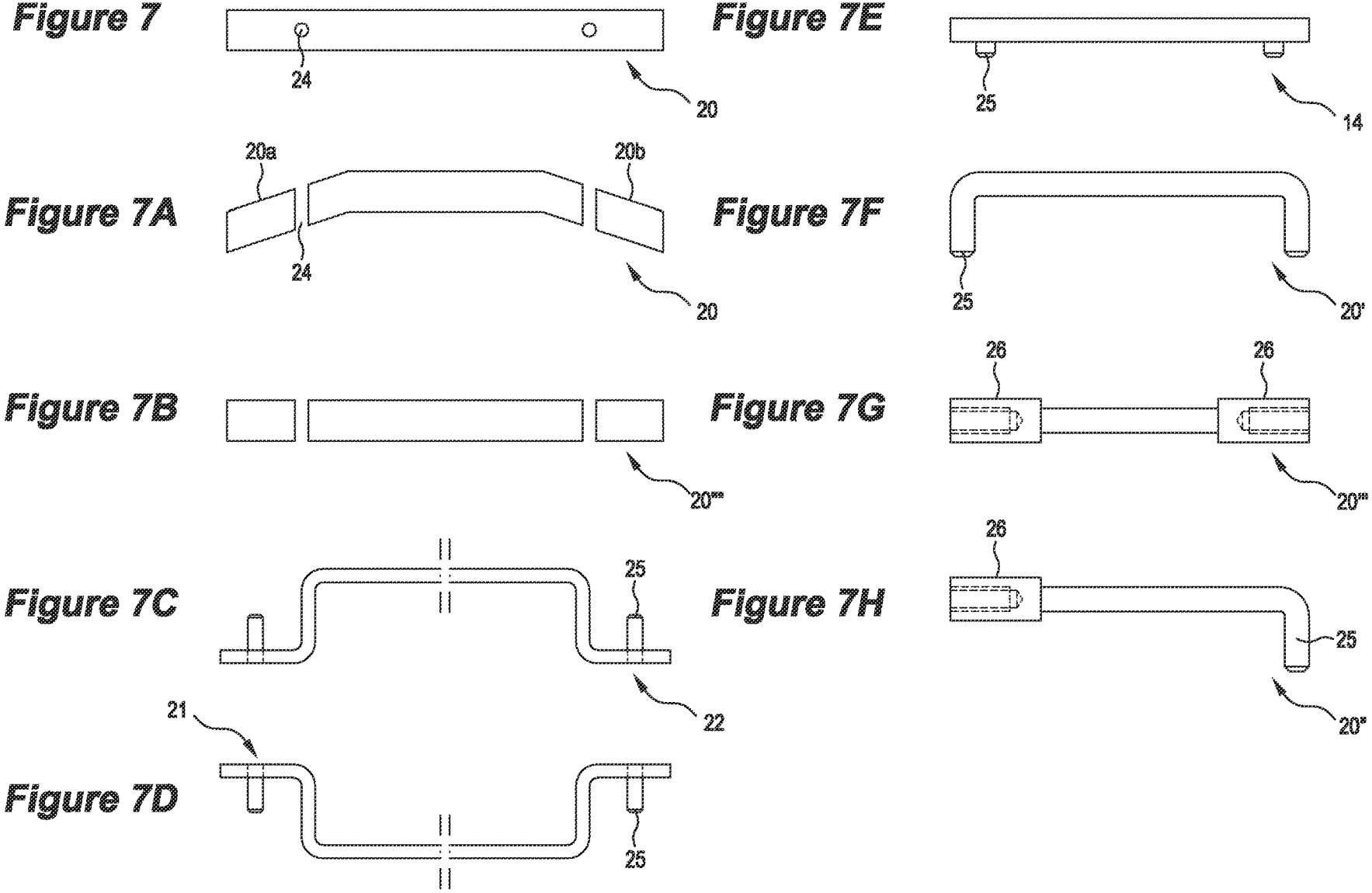
FIG. 7 is a plan view of a brace according to one embodiment of the invention.
FIG. 7A is a sectional side view of the brace of FIG. 7.
FIG. 7B is a sectional side view of an alternative brace according to one embodiment of the invention.
FIG. 7C is a sectional side view of a brace according to one embodiment of the invention providing a recessed face to an outer surface of the module.
FIG. 7D is a sectional side view of a brace according to one embodiment of the invention providing a protruding face to an outer surface of the module.
FIG. 7E is a sectional side view of a brace according to one embodiment of the invention providing a pair of protrusions for engaging the formwork of the side walls.
FIG. 7F is a sectional side view of a brace according to one embodiment of the invention having angled opposing end portions for coupling with formwork members.
FIG. 7G is a sectional side view of a brace according to one embodiment of the invention having a pair of opposing, internally threaded end pieces for receiving bolts therein from an exterior of the formwork members.
FIG. 7H is a sectional side view of a brace according to one embodiment of the invention having a first end with an angled end of about 90 degrees to the brace and a second opposing end providing an internally threaded end piece for receiving a bolt therein.

Foundation module 1 of the invention comprises formwork members 4 which form a pair of parallel, spaced apart side walls 5, 6. Each of the side walls 5, 6 is engaged with the brace 20 by known mechanical means. In FIG. 2, the brace 20 is welded (not illustrated) to the side walls 5, 6. However, in some embodiments the brace 20 may be engaged with a side wall 5 by bolt, screw, weld, adhesive, or clips. Alternatively, the brace 20 can be geometrically configured to engage with the side walls, as illustrated in FIG. 7E. The brace 20 of FIG. 7E is slid into place and held by gravity. The connection between the brace 20 and side walls 5, 6 is strengthened when the settable material 15 is introduced into the space. Furthermore, the principal load directions on the brace 20 are downwards in bearing the weight of the structure thereon and in tension in resisting the side walls 5, 6 from moving away from each other.

FIG. 2 illustrates a foundation module 1 where the pair of vertical reinforcement members 38 is located towards the side walls 5, 6 respectively. The vertical reinforcement members 38 can be welded in position to the brace 20. In some embodiments the brace 20 provides geometrical features for receiving and retaining the vertical reinforcement members 38, this can be in the form of cut-outs, bosses, slots and other mechanical keying features.

The outer pair of horizontal reinforcement members 35 abut the brace 20 and abut the vertical reinforcement members 38, as illustrated in FIG. 2. These horizontal reinforcement members 35 extend along the length of the formwork 4 to provide a component of the reinforcement cage 30 of the module 1.

Additional struts 50 can also be laid along the formwork 4 to add strength to the internal support 40 of the module 1.

Once all desired reinforcement members 35, 38, 50 are in place and engaged with the brace 20 either directly or indirectly, the settable material 15 is introduced to the internal space 10. The settable material 15 is preferably introduced to the space in a pourable or viscous form to aid in the flow of the material around the space 10.

For a given length of side walls 5, 6 a plurality of braces 20 are interconnected between the side walls 5, 6 to hold the side walls in fixed relationship and restrain the settable material 15 to be added to the cavity formed between the side walls. Alternatively, a small amount of settable material 15 can be added to the space 10 and allowed to cure or set. Once set, the bonding of the internal support 40 and side walls 5, 6 will self-support the partially complete module 1, to receive the remainder of settable material 20 to fill the space 10 completely. Where multiple pours of the settable material 15 are to be introduced into the space 10, additional longitudinal struts 50 can be introduced to each layer as the settable material 15 sets thereby providing a surface for supporting said additional struts 50.

Figure 4:
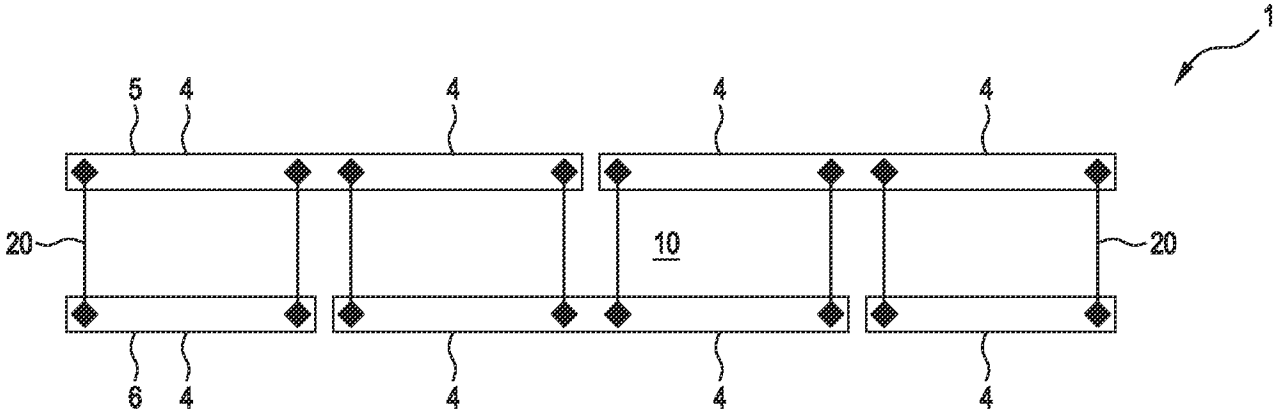
FIG. 4 is a schematic layout of formwork panels of the foundation module, illustrating the overlap conditions between side walls.

Depending on the length and shape of the foundation module 1 required, multiple formwork members 4 can be aligned to form two parallel side walls 5, 6. FIG. 4 illustrates an exemplary configuration in which 6 formwork members of differing lengths can be used to form the opposing side walls 5, 6.

Figure 6A:
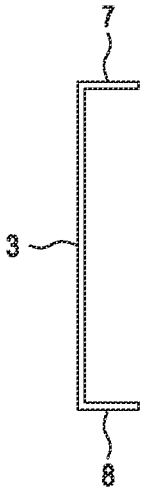
FIG. 6A is an alternative sectional view of a side wall according to the invention, illustrating perpendicular flanges for abutting successive side walls.
Figure 6:
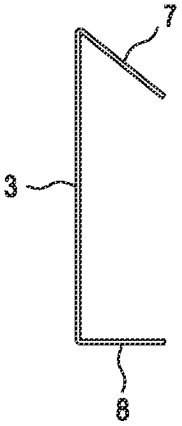
FIG. 6 is a sectional view of the side wall of FIG. 5, illustrating the configuration of the upper and lower flanges of the side wall.
Figure 5:
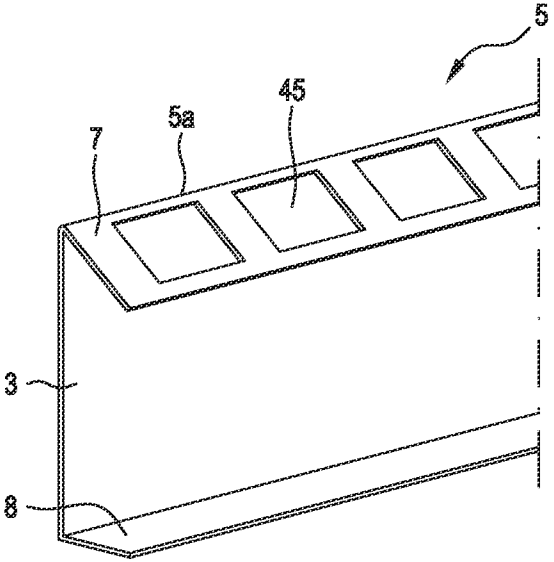
FIG. 5 is a perspective view of a side wall formwork according to one embodiment of the invention.

The side walls 5, 6 each comprise an upper flange 7 and a lower flange 8 an embodiment of which is illustrated in FIG. 5. The upper 7 and lower flanges 8 of the side wall 5 can be formed by folding an upper portion and a lower portion of the side wall 5 to an angle. This provides a round edge 5*a* along each peripheral edge of the side walls 5, 6. The rounded edge 5*a* reduces the risk of damage to workers when constructing foundation modules 1. The bent top portion forms the upper flange 7 which extends from the side wall at an angle of about 45 degrees. This ensures that when the space 10 is filled with settable material 15 the upper flange 7 is integrated into the body of the module 1, secured within the set substrate of the module. FIG. 6 illustrates the side wall 5 in profile, clearly showing the acute angle between the upper flange 7 and a web 3 of the side wall 5.

In some embodiments of the invention, the upper flange 7 may be formed to extend from the side wall at an angle of 90 degrees that is perpendicular to the side wall 5. See FIG. 6A of the application. This perpendicular upper flange 7 facilitates mating with a successive side wall 5' when aligned with the side wall 5 to form an abutment 100 using the modules 1 of the invention. The perpendicular flange 7 also reduces, if not avoids, any surface protrusions to the module 1 which could contact with other members to be seated upon the foundation module 1.

The lower flange 8 is formed in the same manner as described above in relation to the upper flange 7. In some embodiments the lower flange 8 is perpendicular to the side wall 5 to provide a flat and stable base 55 to the module 1.

The side walls 5, 6 may further comprise geometrical feature(s) to allow adjacent side walls to interconnect to extend the length of the foundation module, and thereby incorporate multiple formwork members 4 into the pair of side walls 5, 6, as illustrated in FIG. 4.

In some embodiments, the side walls 5, 6 may be rolled or extruded to form the required geometry for constructing the foundation module 1. Each side wall 5, 6 can range between 500 mm and 4000 mm in length and is formed from a material having between 2 mm and 5 mm gauge depending on the required strength of the finished module 1. The depth of each side wall 5, 6 is set by the length of the web 7 and can range between 100 mm and 1000 mm.

The side walls 5, 6 are made from a structural material, sufficiently strong to support and react the volume of settable material 15 to be introduced to the space 10. As such the material strength and/or gauge of the side walls 5, 6 will be increased as the volume of the space 10 increases. Possible materials for forming the side walls 5, 6 include metals, such as steel, aluminum, and iron. It is also contemplated that in some applications, for example path ways and patios, the side walls 5, 6 may be constructed from plastic materials such as PVC, or HDPE and a settable plastic or rubberised material may be used to fill the space 10. This particular embodiment of the invention is more suitable for lightweight foundation modules 1.

Figure 3:
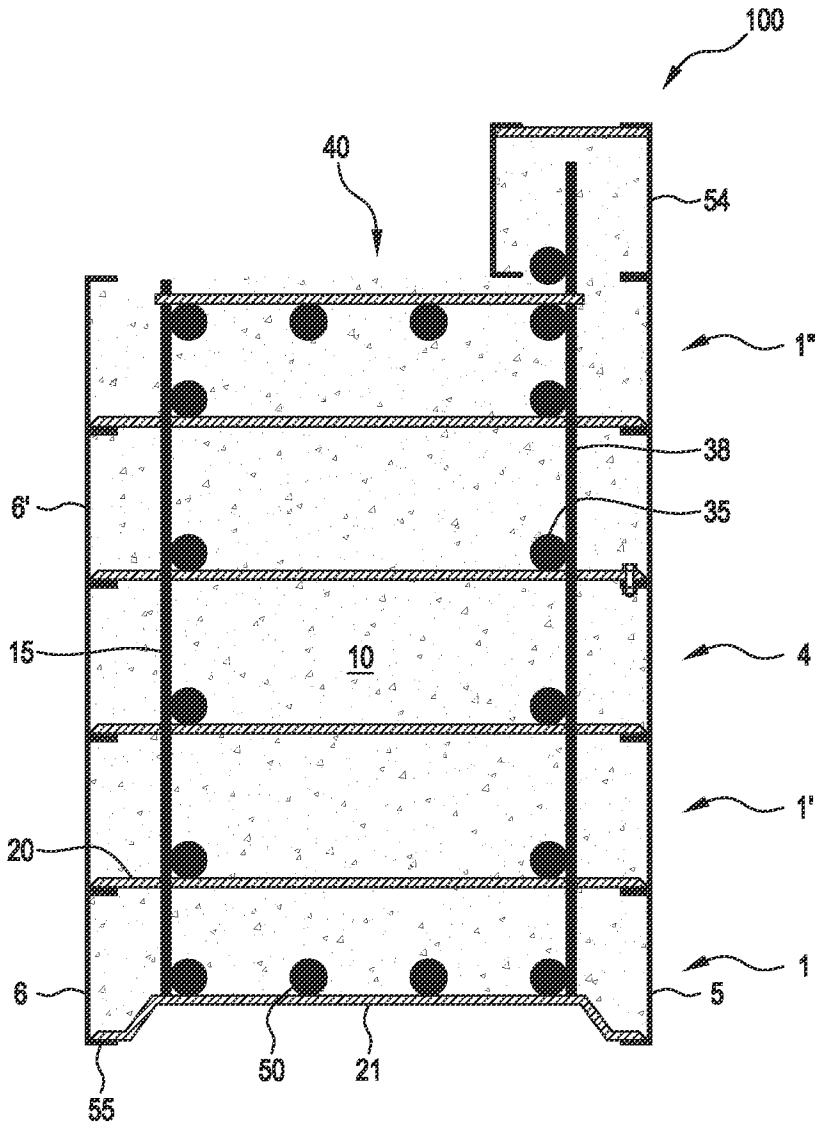
FIG. 3 is a schematic view of an abutment comprising a plurality of foundation modules, illustrating a section through the abutment and the internal reinforcements provided therein according to one embodiment of the invention.

With particular reference to FIG. 3, there is illustrated an abutment 100 comprising a first foundation module 1 and at least one successive foundation module 1', with the first foundation module 1 comprising: a plurality of formwork members 4 that define a pair of side walls 5, 6 such that the side walls 5,6 define a space 10 between the side walls 5, 6; a brace 20 that extends between the pair of side walls 5, 6 and is coupled thereto to hold the side walls 5, 6 in a spaced relationship; a three dimensional reinforcement cage 30 that includes the brace 20, a plurality of first members 38, and a plurality of second members 35 perpendicular to the first members 38, the first members 38 coupled to at least the brace 20 and the second members 35 coupled to at least one of the plurality of the first members 38 and the brace 20, with the successive foundation module 1, comprising: a plurality of formwork members 4' that define a pair of side walls 5', 6' such that the side walls 5', 6' define a space 10' between the side walls 5', 6'; a brace 20' that extends between the pair of side walls 5', 6' and is coupled thereto to hold the side walls 5', 6' in a spaced relationship; a three dimensional reinforcement cage 30' that includes the brace 20' and a plurality of second members 35', wherein the plurality of first members 38 of the first foundation module 1 extend beyond the pair of side walls 5, 6 of that module and engage the brace 20' of the or each successive module 1' and thereby locate the or each successive module 1', wherein the reinforcement cages 30, 30' form an internal support 40 within the spaces 10, 10' between the side walls 5, 6, 5', 6' for receiving a settable material 15, such that the side walls 5, 6, 5', 6' become integrated with the internal support 40 as the settable material 15 sets, to consolidate the foundation modules 1, 1' to form the abutment 100.

Where the foundation module 1 is to be used to form a shallow foundation (a single layer as illustrated in FIG. 2), the form of the upper 7 and lower flanges 8 of the side walls 5, 6 are select to best suit the chosen application. For example, the upper flange 7 is acutely angled to the web 3 to provide a flat upper surface 12 to the module 1 and the lower flange 8 is perpendicular to the web 3 to support the base 55 of the module 1, as illustrated in FIG. 6.

Alternatively, where the module 1 is to be used with successive modules 1 formed on top of one another, for forming an abutment, the upper flanges 7 of each side wall 5, 6 will be perpendicular to the web 3 except that of the uppermost side wall, where the flat upper surface 12 is required.

The upper 7 and lower flanges 8 of the side walls 5, 6 that abut and connect with an adjacent side wall 5', 6' are preferably perpendicular for ease of mating to the abutting flange surfaces.

The lower 7 and upper flanges 8 comprise at least two apertures 45. In some embodiments a series of apertures 45 are provided in each of the lower 7 and upper flanges 8. These apertures 45 will reduce weight and material usage in the side walls 5, 6 and also, these apertures 45 improve flow of the settable material 15 within the space 10. Specifically, the apertures 45 will reduce the impact of the flanges 7, 8 which extend outwardly into the space 10 and which could thereby hamper the flow of settable material 15. The apertures 45 may also reduce the formation of air voids and occlusions within the finished module 1, as there are fewer recesses for air bubbles to become trapped in.

The apertures 45 further provide a simple and effective mounting means for securing a side wall 5, to a successive side wall 5' or to the brace 20, or even both. The apertures 45 are dimensioned to receive a mechanical fastening, for example a bolt 17 (see FIG. 19). The bolt can be a 12 mm bolt (but it is contemplated to receive larger or smaller than 12 mm bolts depending on the application for which the module 1 is to be constructed). The apertures 45 are spaced along the side walls 5, 6 at regular intervals. There may be as few as two apertures 45 in each flange 7, 8 or a plurality of apertures 45 spanning the entire length of the flange 7, 8. The apertures may be of different sizes such that some are suitable for receiving bolts 17 and other apertures are oversized to further improve material flow within the space 10.

Figure 3A:
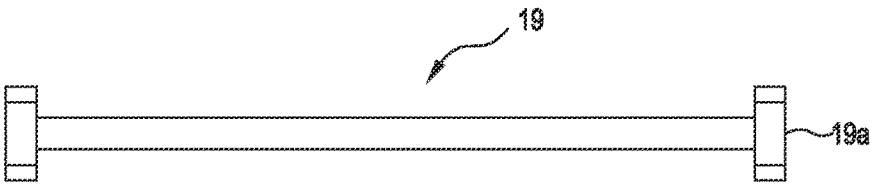
FIG. 3A is a cross-sectional view of a sliding brace for coupling a pair of opposing side walls at a spaced distance from one another.
Figure 3B:
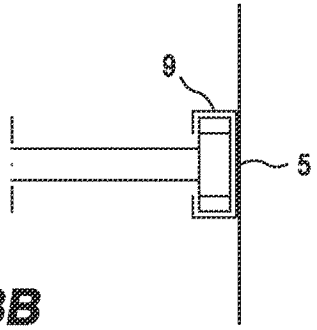
FIG. 3B is a cross-sectional view of a first end of the sliding brace coupled to a C-channel formed in an inner surface of a side wall panel.
Figure 3C:
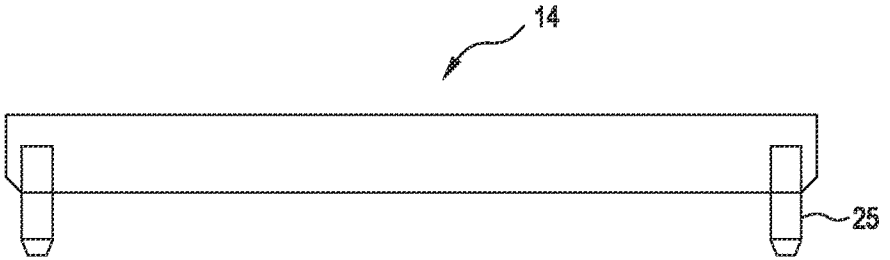
FIG. 3C is a cross-sectional view of a slotted brace for coupling a pair of opposing side walls at a spaced distance from one another.
Figure 3D:
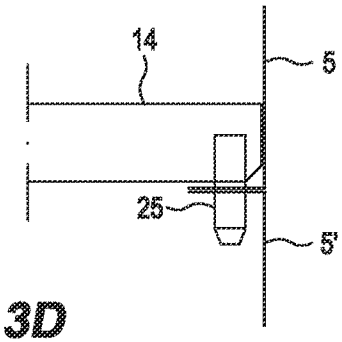
FIG. 3D is a cross-sectional view of a first end of the slotted brace coupled to an inner surface of a side wall panel via an aperture within the side wall panel.
Figure 3E:
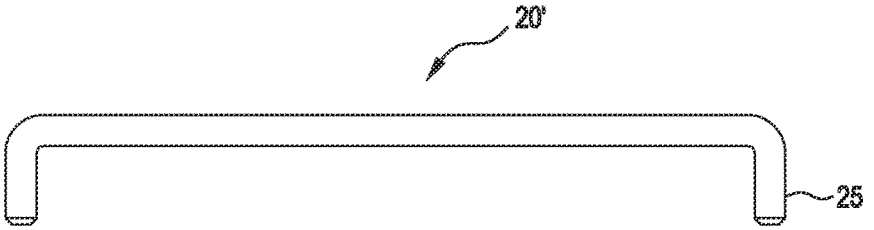
FIG. 3E is a cross-sectional view of an alternative slotted brace formed having a pair of integrated, angled ends for coupling a pair of opposing side walls at a spaced distance from one another.
Figure 3F:
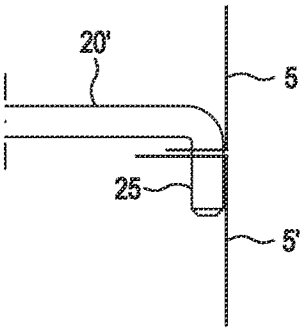
FIG. 3F is a cross-sectional view of a first end of the slotted brace of FIG. 3E coupled to an inner surface of a side wall panel via an aperture within the side wall panel.

A more detailed view of some embodiments of the brace are illustrated in FIGS. 3A, 3C and 3E, and their coupling means with the side walls in FIGS. 3B, 3D and 3F.

The first embodiment in FIG. 3A is a sliding brace 19, having a central beam and a pair of oversized ends 19*a*. The beam is formed from a concrete reinforcing bar (rebar) and is about 12 mm in diameter. It is contemplated that larger or smaller gauges of bar may be used to form the brace 19 depending on the required load bearing capacity thereof. The oversized ends 19*a* can be rounded, square or rectangular and preferably have a constant height. The ends 19*a* are slidingly received into a C-channel 9 formed on an inner surface of the side walls 5, 6. The brace 19 is then slid into the desired location along the length of the side wall 5, 6 and can be secured by welding or adhesives in the pre-determined location. While FIG. 3B illustrates the C-channel 9 as a separate component that is bent and subsequently engaged with the inner side walls 5, 6, the C-channel 9 can also be formed from the side wall 5, 6, for example, bent, formed, stamped or pressed. This would not necessarily provide a smooth outer surface to the finished module 1, but aesthetically, this may not be of concern. Where a subsequent structure 110 is to be jointed to the abutment recessed form in the outer side walls 5, 6 can be used to support externally facing reinforcements or recessed to receive fluid concrete to key the two adjacent structures 110 together.

FIG. 3C illustrates a brace 14 constructed from a central member and a pair of end projections or pins 25. The central member can be a flat, rounded or oval cross-section. The pins 25 are welded to the opposing ends of the central member prior to coupling with the side walls 5, 6. The pins 25 are located in the holes 45 of a side wall 5, 6, or a pair of adjacent holes 45 of a pair of adjacent side walls, 5, 5', to thereby secure a pair of adjacent side walls 5, 5' to on another at a first end of the brace 14. Similarly a pair of adjacent side walls 6, 6' can be secured to one another at an opposing end of the brace 14 by a further pin 25 thereby coupling four side walls 5, 6, 5', 6' to one another in a spaced apart relationship. Additional braces 14 can be added to further stabilise the side wall arrangement. FIG. 3D illustrates this coupling between side walls 5, 5' and the brace 14.

FIG. 3E illustrates a brace 20', wherein the opposing ends of the brace are bent at about 90 degrees to provide end protrusions for being received into the side walls 5, 6. The protrusions can be chamfered or tapered for ease of locating within the holes of the side walls 5, 6. In this manner the brace 20' aligns the holes 45 of respective side walls 5, 5' to be coupled together and provides a locking means under gravitational force, to hold the assembly together before receiving the settable substrate (illustrated in FIG. 7G). In some embodiments the brace 20' can be inserted into the aperture/s 45 from an underside thereof, however, the brace 20' will require additional adhesion to be retained within the oversized hole 45, for example welding, or adhesives. In some embodiments of the abutment 100 the braces 20' can be located in both an upwards and a downwards orientations (see FIGS. 10B and 10C), such that the preassembled formwork and reinforcement can be lifted and located to a secondary site to received fluid concrete therein. The arrangement of the braces 20' in both orientations assists in holding the formwork and reinforcement together during transportation.

Figure 10A:
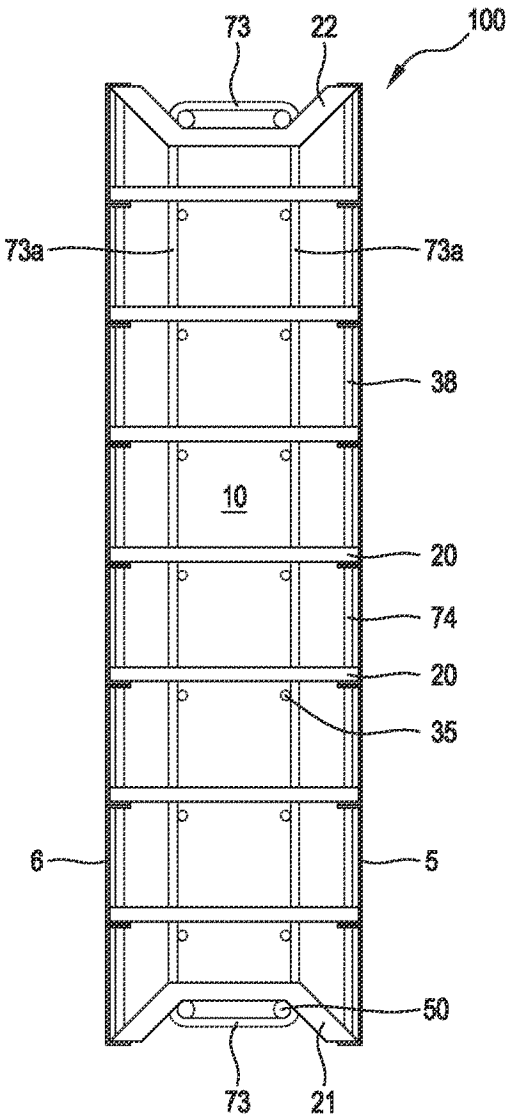
FIG. 10A is a cross-sectional view of the wing wall abutment of FIG. 10.
Figure 10:
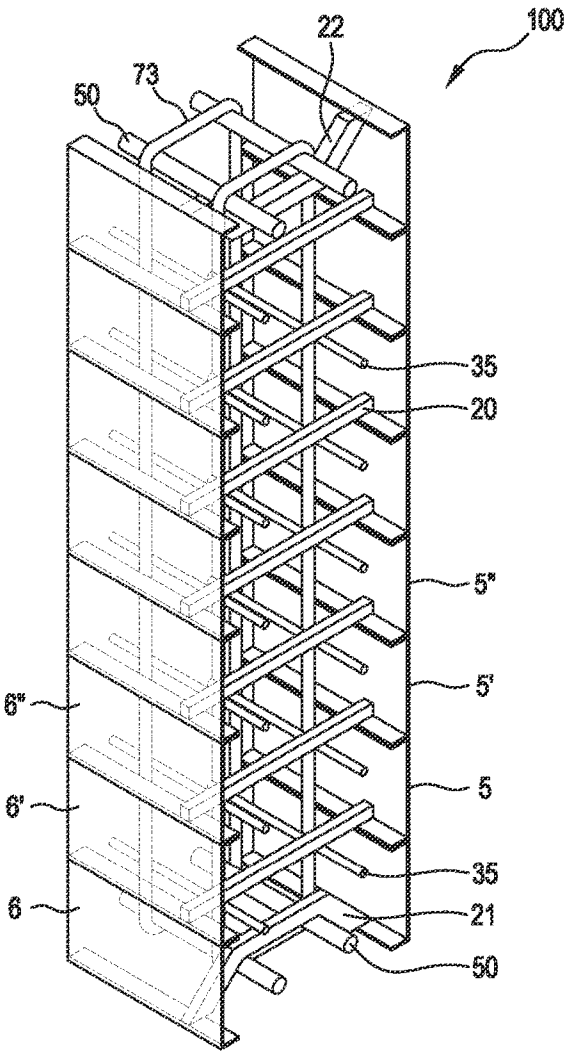
FIG. 10 is a perspective view of a section of a wing wall of an abutment according to the invention.
Figure 10C:
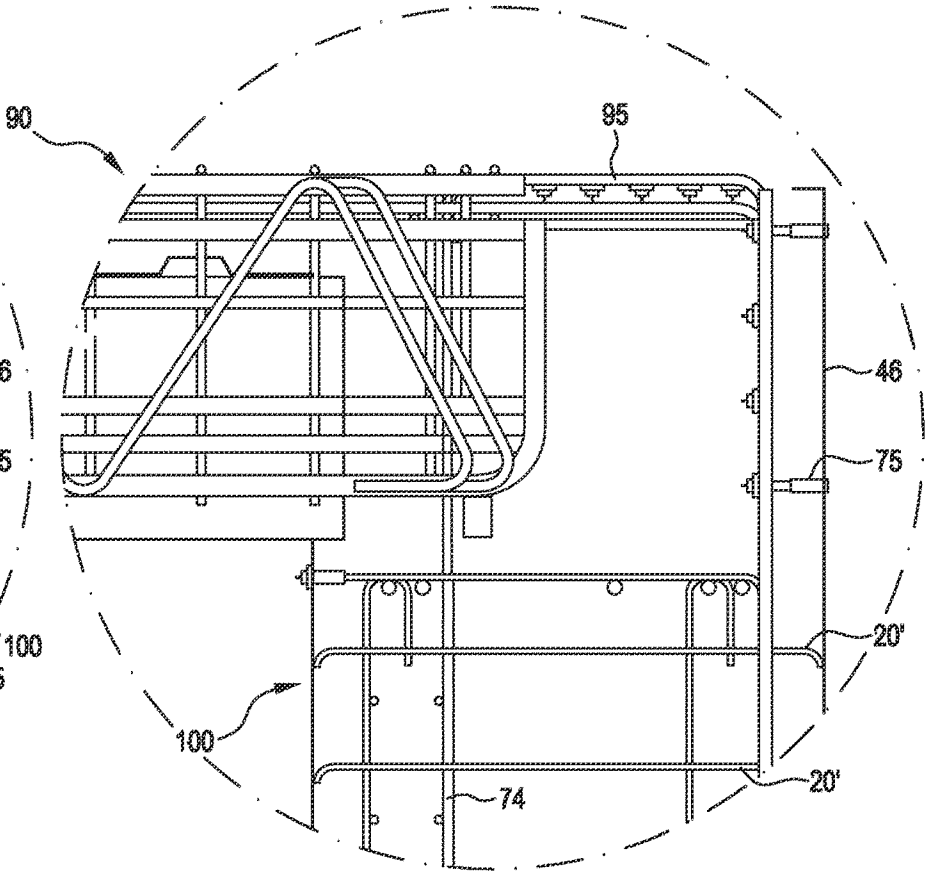
FIG. 10C is a cross-sectional view of an abutment having an internal reinforcement structure integrated with the reinforcement structure of a bridge using slotted braces in a down-turned orientation.
Figure 10B:
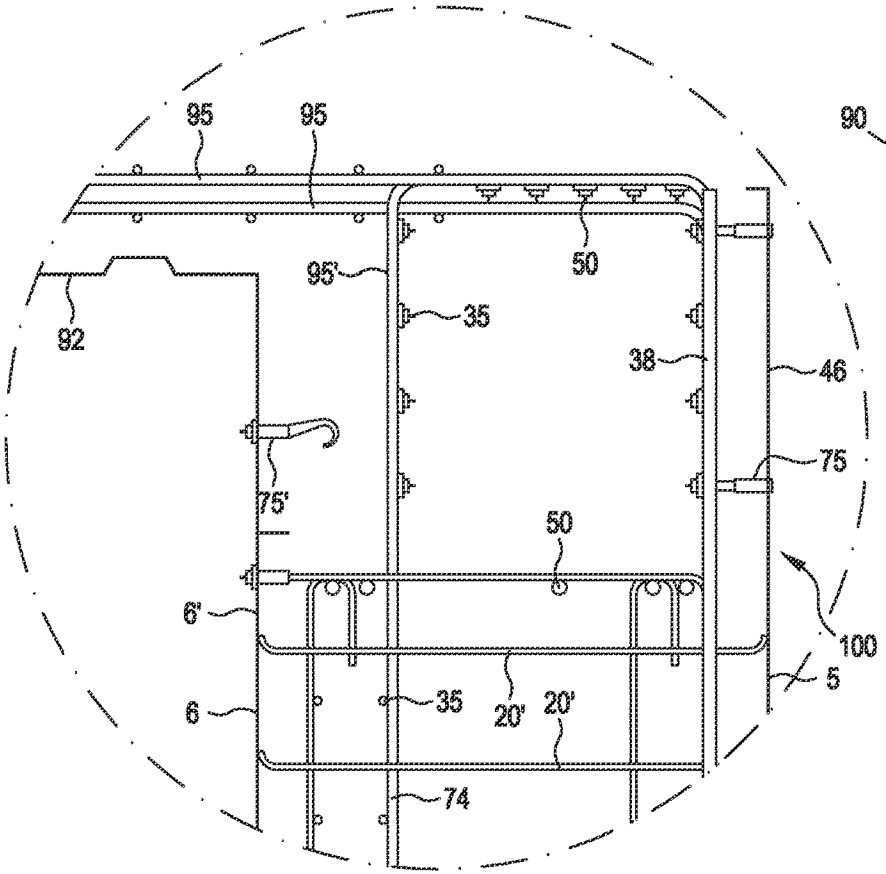
FIG. 10B is a cross-sectional view of an abutment having an internal reinforcement structure integrated with the reinforcement structure of a bridge using slotted braces in an up-turned orientation.

FIGS. 10B and 10C illustrate tie-bars 75 and 75' which are used to tie the side walls 5, 6 to the reinforcement cage 30 within the cavity of the abutment 100. The tie bars 75, 75' each have a threaded internal end bore to receive a threaded fastener from the outside surface of the side walls 5, 6. The fastener (not illustrated) can be accessed from the outer planar surfaces of the side wall 5, 6 to tension the side walls and locate the side walls relative to the cage 30. Tie bar 75 can be bolted or welded or otherwise adhered to the cage 30, while tie-bar 75' has a hooked end for engaging and coupling to the cage 30.

As the brace 20' of FIG. 3E is formed from a straight piece of rebar, with two angled bends at opposing ends thereof, there is opportunity to reduce the cost of producing this brace 20' over the alternatively described braces. The brace 20' does not require any additional tooling or finishing or joining and can be easily mass produced in countries where resources and machinery are scarce.

FIG. 3F illustrates the brace 20' inserted into a pair of subsequent apertures 45 in a pair of side walls 5, 5' in a downwards orientation. The aperture 45 is about 13 mm in diameter and the brace 20' is about 12 mm in diameter such that there is no interferences when location the braces 20' within the side walls.

Two additional forms of brace are illustrated in FIG. 3, a series of flat braces 20 throughout the abutment 100 and a raised brace 21 at the base 55 of the abutment 100. The raised brace 21 can be turned to form a recessed brace 22, illustrated in FIGS. 8 and 8A.

FIGS. 7-7D illustrate a plurality of different embodiments of the braces 20, 21, 22 according to the invention. FIG. 7A is a top view of the brace 20, illustrating two mounting points, illustrated as holes 24. In this embodiment, the brace 20 has a regular section being essentially an elongate plate. The brace 20 has a width of approximately 10 mm and a material gauge of about 2.4 mm but both the gauge and width of the brace 20 can be increased or decreased depending of the structural strength of the foundation module 1 and the structure to be supported thereon. The length of brace 20 can also be varied, for example the brace 20 of FIG. 3 is approximately 900 mm in length as compared to the brace 20 of FIG. 8A, which is approximately 350 mm in length.

It is contemplated that a range of standard sizes of brace 20 can be produced, e.g. 900 mm, 450 mm, 300 mm and 100 mm. These braces 20 once bolted or welded to a pair of opposing side walls 5, 6 will set the width of the foundation module 1. As such, the standard sizes can be designed and manufactured to complement and construct different sizes, and strengths of foundation. For example a 900 mm length brace 20 in 10 mm width and 2.4 mm gauge may be sufficient to construct a foundation for a small bridge, whereas, a 350 mm length brace 20 with 100 mm width and 2.4 mm gauge may be suitable to construct a pair of wing walls to a primary foundation or abutment.

Figure 8A:
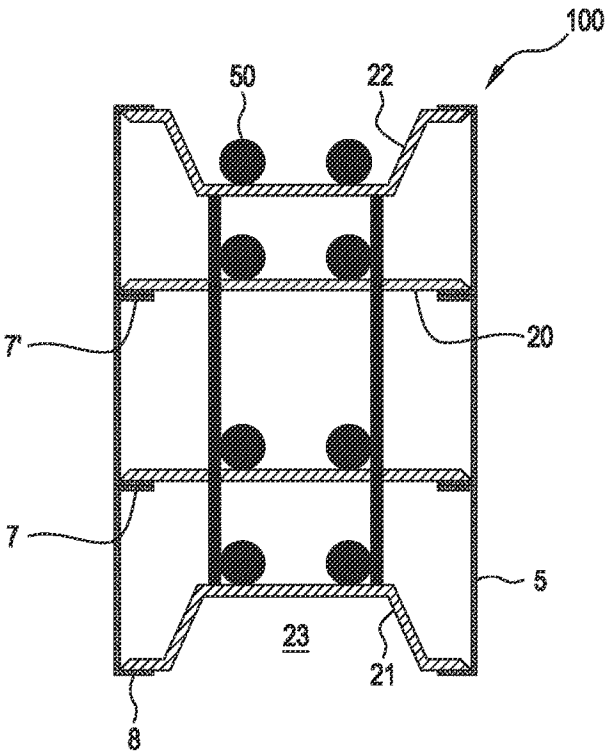
FIG. 8A is a schematic view of a narrow abutment according to one embodiment of the invention, such as may be used for a wing wall.
Figure 8:
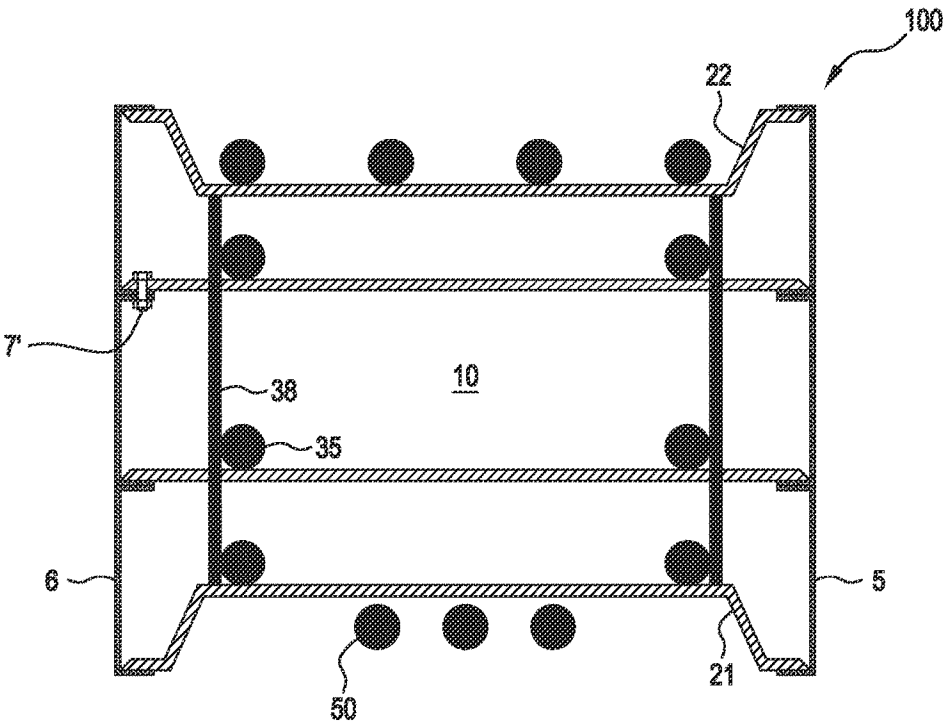
FIG. 8 is a schematic view of a broad abutment according to one embodiment of the invention.
Figure 9:
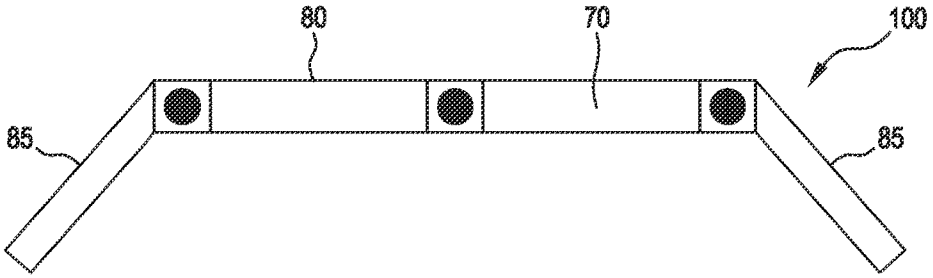
FIG. 9 illustrates a schematic plan view of an abutment comprising a central primary wall and two end, wing walls.

FIGS. 8 and 8A illustrate how varying the length of the brace 20 will alter the overall geometry and structure strength of a finished abutment 100 comprising a plurality of foundation modules 1. FIG. 9 illustrates a bridge abutment 100 comprising a central, primary wall 80 and two opposing wing walls 85 at approximately 45 degrees to the primary wall 80. An abutment 100 of this type would be constructed at either end of a bridge 90 to provide foundation and support to the finished, combined structure 110 and further, to provide support to any ramp or intermediate structure, for example a ramp connecting the new bridge to an existing road structure.

FIG. 7A illustrates a cross-sectional view through the brace 20 of FIG. 7. The section is regular and lends itself well to volume manufacture. The holes 24 are illustrated to pass throughout the section of the brace 20 to allow vertical reinforcement members 38 to pass therethrough. It is further contemplated that in some embodiments the holes 24 can be provided as slots allowing the brace 20 to be slid into place around the vertical reinforcement members 38. Where the brace 20 provides closed holes 24 each brace 20 can be threaded onto the vertical reinforcement members 38 as each layer of foundation module 1 is constructed to form the abutment 100.

The brace shown in FIG. 7B provides flared ends 20*a*, 20*b* which are angled to cooperate with the upper 7 and lower flanges 8 of the side walls 5, 6 when multiple modules 1 are to be formed on top of one another. The flared, end portions 20*a*, 20*b* are illustrated in FIG. 7B to only flare in one direction.

FIGS. 7C and 7D are mirror images of each other, FIG. 7C providing a recessed brace 22 for locating as the top 54 or the base 55 of the abutment 100. FIG. 7D in contrast provides a raised brace 21 also for locating at the top 54 or base 55 of the abutment 100.

FIG. 7G is a sectional side view of a brace 20''' according to one embodiment of the invention having a pair of opposing, internally threaded end pieces 26 for receiving bolts therein from an exterior of the formwork members. The brace 20''' of FIG. 7G requires co-operating holes in the side walls 5, 6 for alignment therewith, through which a bolt or alternative threaded fastener is inserted from an exterior of the side walls 5, 6. The threaded portion of the bolt shank is received into the threaded end piece 26 of the brace 20''' and rotatably tightened thereto, tensioning the brace 20''' across a cavity 70 between the opposing side walls 5, 6.

Figure 25:
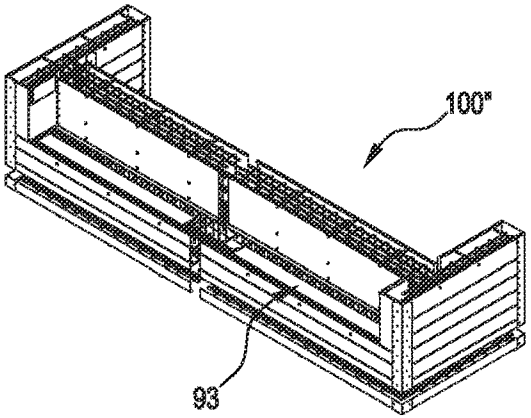
FIG. 25 is a perspective view of an embodiment of the abutment having angled wing walls each wing being offset from the primary wall by 090 degrees.
Figure 25A:
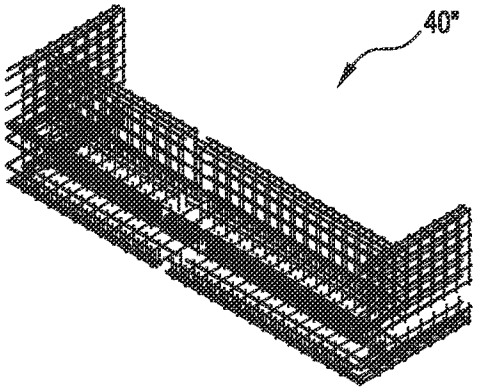
FIG. 25A is a perspective view of the abutment of FIG. 25 with all formwork members removed to illustrate the internal support therein.
Figure 24:
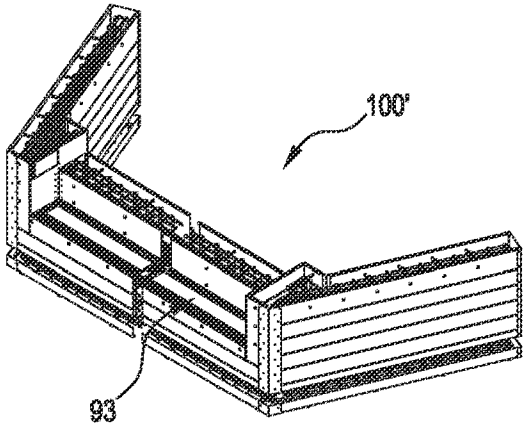
FIG. 24 is a perspective view of an embodiment of the abutment having angled wing walls each wing being offset from the primary wall by 067 degrees.
Figure 24A:
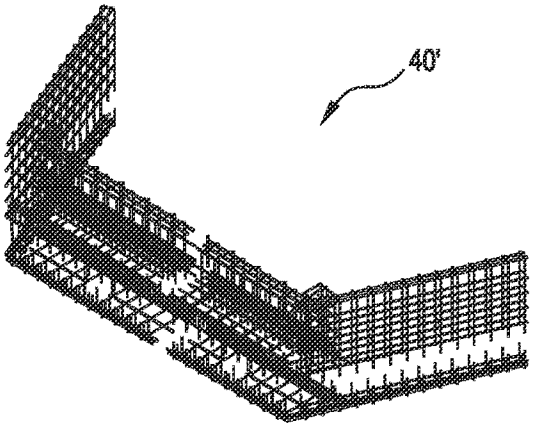
FIG. 24A is a perspective view of the abutment of FIG. 24 with all formwork members removed to illustrate the internal support therein.
Figure 23:
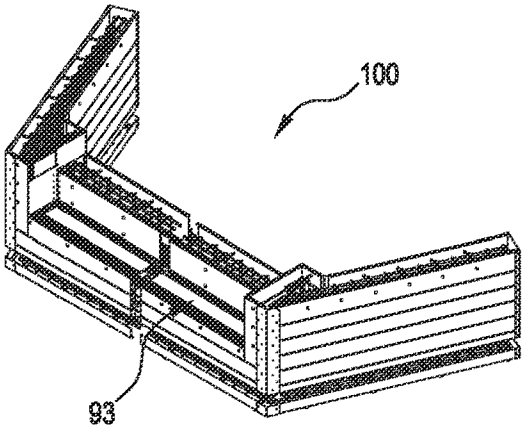
FIG. 23 is a perspective view of an embodiment of the abutment having angled wing walls each wing being offset from the primary wall by 045 degrees.
Figure 23A:
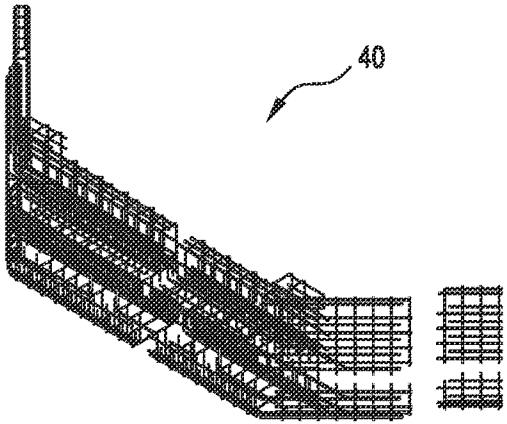
FIG. 23A is a perspective view of the abutment of FIG. 23 with all formwork members removed to illustrate the internal support therein.

FIG. 7H is a sectional side view of a brace 20'' according to one embodiment of the invention having a first end with an angled end of about 90 degrees to the brace (as described herein in reference to FIG. 7F) and a second opposing end providing an internally threaded end piece 26 for receiving a bolt therein (as described herein in reference to FIG. 7G). This brace 20'' is used between a side wall 5 or 6 having an upper 7 or lower flange 8 for receiving the angled portion of the brace 20. The opposing end is mounted to a side wall 5 or 6 without an upper 7 or lower flange 8, via a hole and fastener arrangements. An example of this is illustrated in FIGS. 23-25 where a seat 93 is formed within the abutment for receiving a bridge 90. The side walls 5, 6 around the seat 93 can be formed from a plurality of side walls 5, 6 or alternatively a single extended side wall 46 can be configured to extend the predetermined height of the seat 93, illustrated in FIG. 26.

Figure 26:
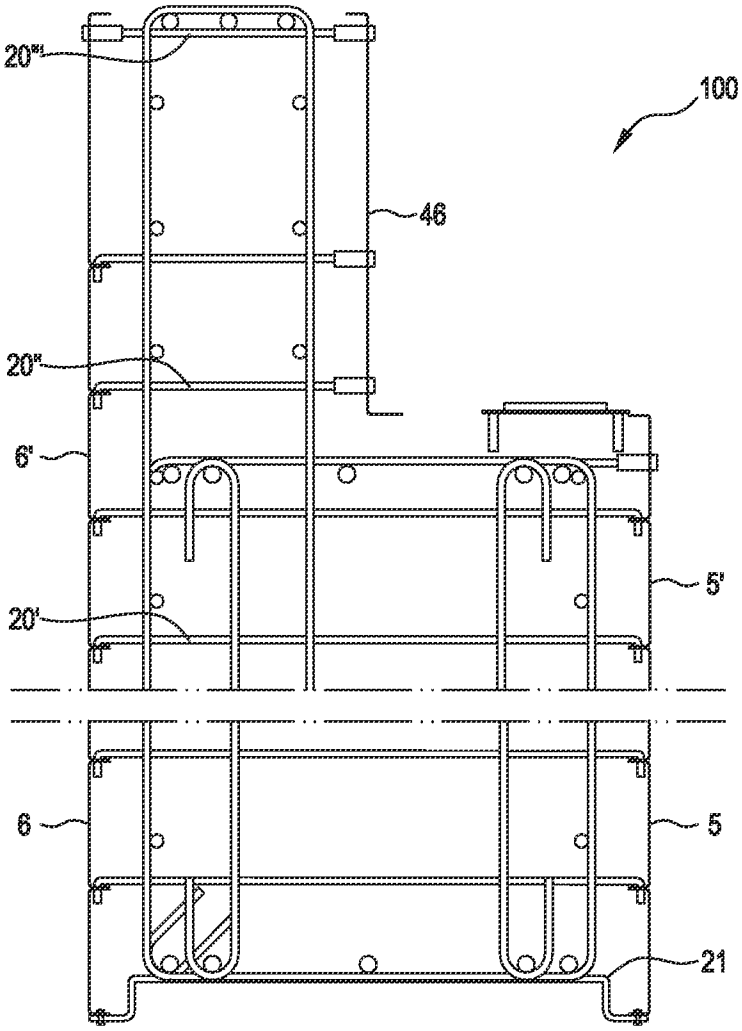
FIG. 26 is a cross-sectional view of an abutment using an extended side wall to form a recessed seat within the abutment for receiving and supporting a bridge (not illustrated)

Illustrated further in FIG. 26 is recessed brace 21 (also illustrated in FIG. 7D). The brace 21 provides two upturned protrusions 25 which are received into holes within the side wall flanges to hold the pair of side walls 5, 6 at a predetermined distance from one another. Furthermore, brace 21 is recessed to lift the brace upwards, away from the foundation on which the abutment 100 is to be erected.

Above brace 21 is a brace 20' having a pair of angled ends to provide protrusions 25 for engaging the side walls 5, 6 (illustrated in FIG. 7F). The brace 20' is dropped in from about the mating flanges of the adjacent side walls 5, 5' and 6, 6' and held in place by gravitational force. This is sufficient until a settable substrate is introduced to the cavity 70 as the primary loads on the side walls 5, 6 are acting downwardly with the mass of the abutment 100 and loading the braces 21, 20' in tension (pulling the two end protrusions away from one another). Once the settable substrate is introduced into the cavity 70 the hydrostatic forces in a horizontal direction are resisted by the opposing side walls of the abutment, in a planar fashion. This creates an equilibrium state between the hydrostatic forces reacting loads through the linear members of the reinforcement cage while also resisting axial/rotational forces.

The extended side wall 46 surrounds the seat 93 of the abutment and is configured to be larger than the individual side walls 5, 6. The extended side wall 46 has an upper 7 and a lower flange 8 but no intermediate flanges for engaging with protrusions 25 of the braces 21 or 20'. Brace 20" provides a first end having a protrusion and a second end providing a threaded end portion 26, threadingly engaged to the extended side wall 46 via a threaded fastener. This embodiment of the brace 20" is illustrated in FIG. 7H.

A still further embodiment of the brace 20'" provides threaded end pieces 26 at each of the opposing ends thereof (as illustrated in FIG. 7G and FIG. 26). As the brace 20'" is tightened by threaded fasteners at either end thereof, the brace 20'" becomes tensioned across the cavity 70. The threaded end pieces 26 are located below the upper flange 7 of the side walls 6, 46 such that as the settable substrate e.g. concrete, is introduced into the cavity 70, the end portions 26 will be entirely covered once the concrete has cured.

Returning to FIG. 3, the base 55 of abutment 100 comprises a raised brace 21, in contrast to the flat braces 20 employed through the remained of the abutment 100. A plurality of braces 21 in 10 mm wide strips can be attached to the lower flange 8 of the lower most side walls 5, 6. Alternatively the base 55 of the abutment 100 can comprise a closer in the form of a continuous sheet member 28 having the same cross-section as that of the brace 21 to seal the base 55 of the abutment 100 or module 1 (see FIG. 13A). Joining a continuous sheet 28 with the formwork 4 provides a defined space 10 for receiving the settable material 15. Without the continuous sheet 28 the substrate 60 upon which the module 1 is located performs the function of the continuous sheet 28 effectively sealing the space 10 to receive and support the settable material 15 as it sets. However, depending on the desired location for the foundation module 1, it may be necessary to seal all or part of the base 55 of the module 1 before introducing the settable material 15.

Illustrated in FIG. 3 are a number of supplemental longitudinal reinforcement members shown as struts 50. Specifically, FIG. 3 shows two struts 50 spaced across the base 55 of the module 1 and a another two struts 50 spaced evenly across the top portion 54 of a successive module 1'.

The struts 50 can be laid longitudinally inside of the space 10 and welded to the raised brace 21 if present (see FIG. 3). If the abutment 100 is to be constructed without a raised brace 21 the struts 50 can be loosely held in place by spacers across the base 55 of the module 1 and will be partially held in position by gravity. Once the settable material 15 is added and sets, the struts 50 will be firmly held in place within the abutment 100.

An alternative use of the struts 50 is shown in FIG. 8, where the struts 50 across the base 55 of the abutment 1 are placed loosely under the raised brace 21. As the brace 21 is non-continuous across the base 55, connected by welding or bolting at regular intervals along the length of the side walls 5, 6 the settable material 15 will permeate through the space 10 and beyond the brace 21, thereby enveloping and integrating the loose struts 50 into the abutment 100 as it sets.

FIG. 10 illustrates a perspective view of a section through a wing wall 85 of an abutment 100. The same abutment section is illustrated in cross-sectional view in FIG. 10A. A ligature 74 can be seen encircling the horizontal reinforcement members 35 of the reinforcement cage 30 to draw the internal support 40 together and resist bowing under load. In FIG. 10A the ligature 74 is formed from four pieces: two U-braces 73 at either end of a pair of vertical uprights 73*a*. These ligature components are additional reinforcements over and above the three dimensional reinforcement cages 30. The first members 38 and second members 35 and brace 20 are also illustrated within the space 10 between the pair of side walls 5, 6.

The raised 21 and recessed brace 22 are purposefully located within the confines of the space 10, such that when the settable material 15 is introduced, a top surface 103 of the abutment 100 is free from protrusions of exposed reinforcements.

Figure 11A:
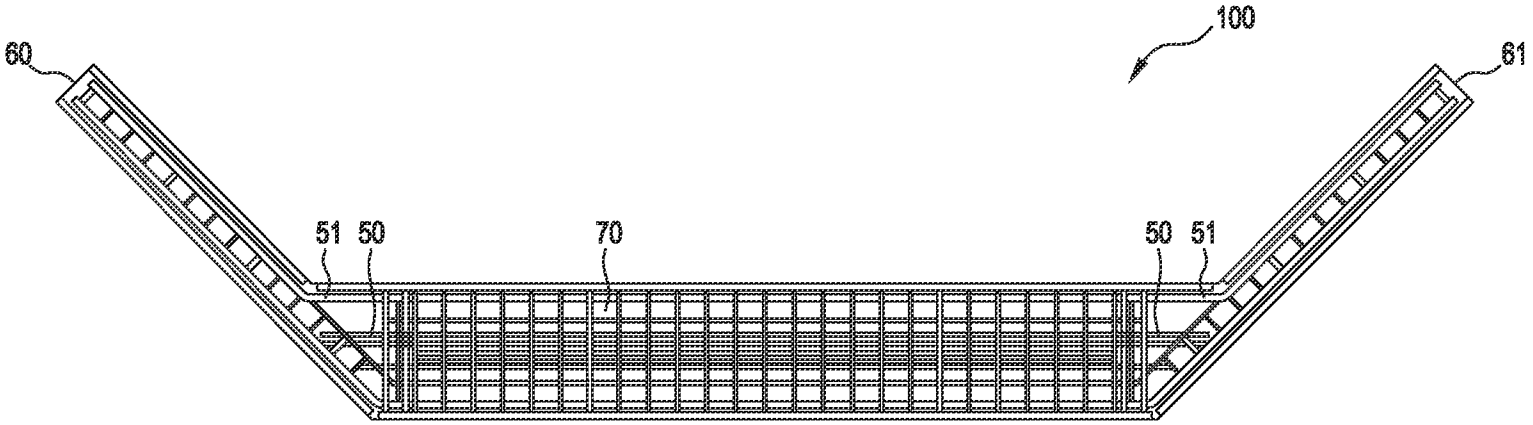
FIG. 11A is a plan view of the abutment of FIG. 11, prior to the introduction of a settable material therein.
Figure 11:
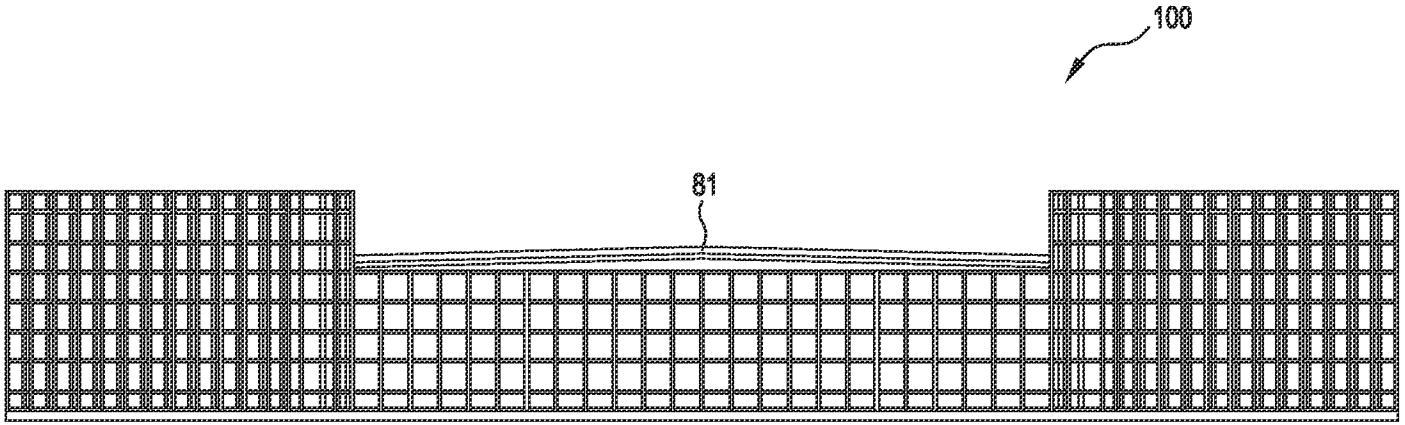
FIG. 11 is a front view of an abutment comprising a primary wall and two end wing walls, the primary wall being inclined for receiving decks of a bridge.

FIG. 11 is a front view of an abutment 100 comprising a primary wall 80 and two end wing walls 35 angled to the primary wall 80. Furthermore, the profile of the primary wall 80 can be seen to incline toward a central point 81. This provides an incline to receive and support a pair of bridge decks 94, which will be described in further detail herein. The incline allows for a natural drainage of surface liquid from the decks 94.

FIG. 11A illustrates a plan view of the abutment of FIG. 11, prior to the introduction of a settable material therein. In this view, the location and layout of the internal support 40 can be clearly seen running through the wing walls 85 and into the primary wall 80 of the abutment. In this embodiment, the primary wall 80 is the main load bearing member of the abutment, and the wing walls 85 provide stability to the primary wall 80. Also illustrated in FIG. 11A is a pair of end walls 60, 61 which close the space 10 within the abutment 100 to form a closed cavity 70. In some embodiments, the end walls 60, 61 are not required as the substrate upon which the abutment 100 is to be erected may provide geographical features that naturally seal the cavity 70 for example a trench or void into which the abutment/reinforcement is to be formed.

The end walls 60, 61 are of the same construction and material as the side walls 5, 6, although the flanges 62, 63 are oriented vertically in use. The flanges 62, 63 may also be significantly deeper that the flanges 7, 8 of the side walls 5, 6 to provide a greater overlap with the side walls 5, 6 at the ends of the wing walls 85. The sections of the end walls 60, 61 are C-shaped and can be bolted, welded or otherwise adhered to the ends of the wing walls 85 to form the cavity 70.

Figures 12, 12A, 12B:
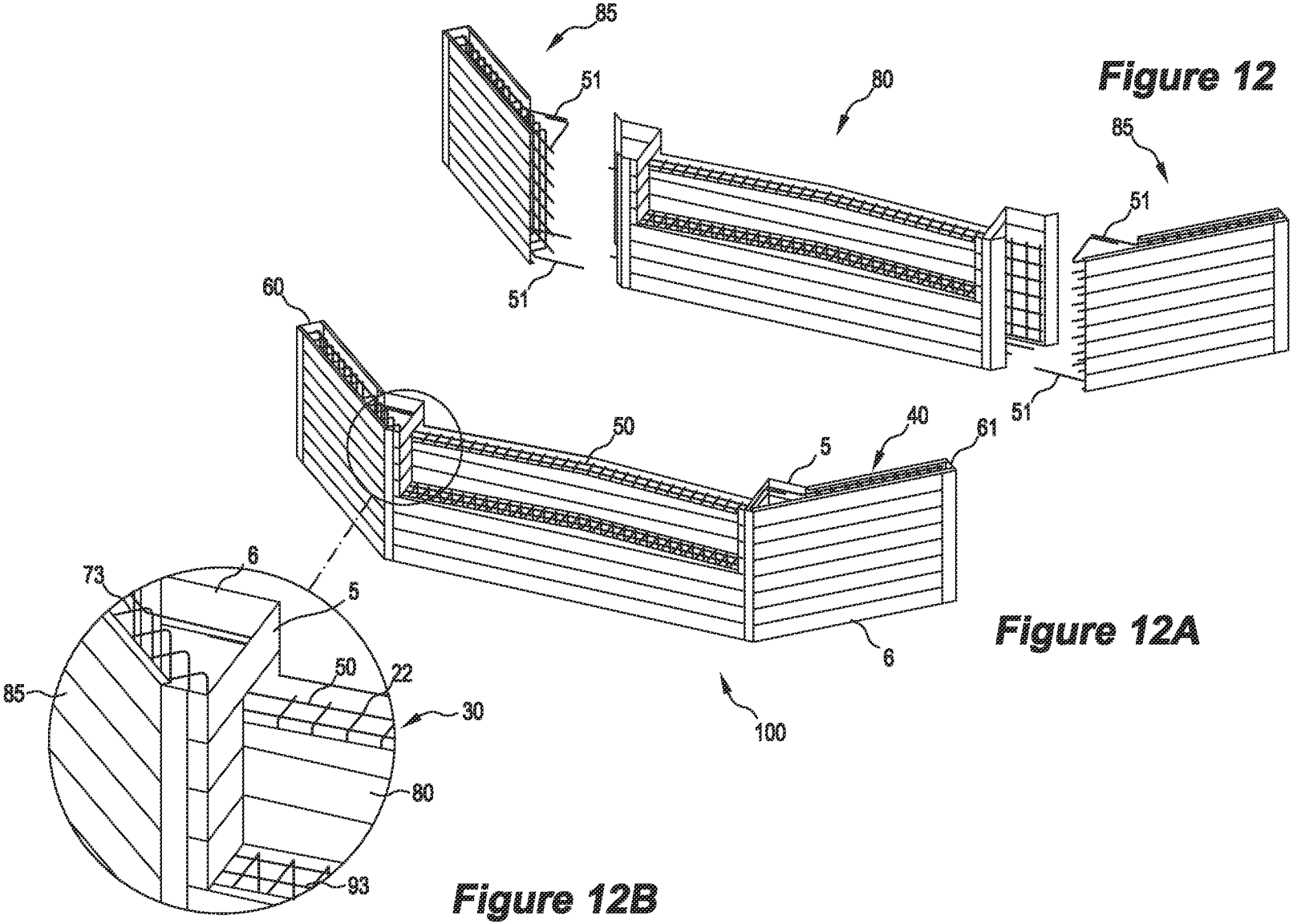
FIG. 12 is a perspective view of the abutment of FIG. 11, prior to bringing the primary wall and the wing walls together.
FIG. 12A is a perspective view of the abutment of FIG. 11 combining the wing wall and the primary wall.
FIG. 12B is an enlarged view of a join between the wing wall and primary wall as highlighted in circle A of FIG. 12A.

The abutment 100 of FIGS. 11 and 11A is formed in three pieces, as illustrated in FIGS. 12-12B. The wing walls 85 and the primary wall 80 are formed as described herein. The struts 50 lie parallel to the side walls 5, 6 of the wing walls 85 and may extend from the wing walls 85. Furthermore, these struts 50 may have angled sections 51 that define the angle at which the abutment wing walls will be joined to the primary wall. The extending, angled struts 51 can be located adjacent to the primary wall, wherein the extending struts 51 along with additional reinforcements, if required, are intertwined, to bring the three sections of the abutment 100 into close proximity and seal the cavity 70 therein. Once all three pieces are brought together in situ, the settable material 15 is introduced into the cavity 70. It may be necessary to correctly locate the primary wall 80 first, and even to pour a portion of settable material 15 into the space 10 to stabilise the primary wall 80.

FIGS. 12A and 12B illustrate how a side wall 5, 6 may be used as an end wall, for forming a cavity 70 within the abutment 100. In this Figure a seat 93 is formed within the abutment for receiving a bridge 90 (this is described in greater detail in relation to FIG. 13). The settable material 15 will not escape from the seat 93 once a bridge tray 92 or alternative bridge 90 structure is placed on the seat 93. The settable material 15 may be introduced into the cavity 70 to a level below the seat 93 to further support the abutment 100 prior to the placing of the bridge 90 on the seat 93.

Additional Reinforcements

In one aspect the invention provides a structure 110 comprising an abutment 100 and a bridge 90, wherein the abutment comprises a plurality of foundation modules 1 and a bridge 90. The bridge and the abutment are independently constructed, co-located and simultaneously formed into the structure 110 by the introduction of the settable material 15, as illustrated in section in FIG. 13.

Figure 13:
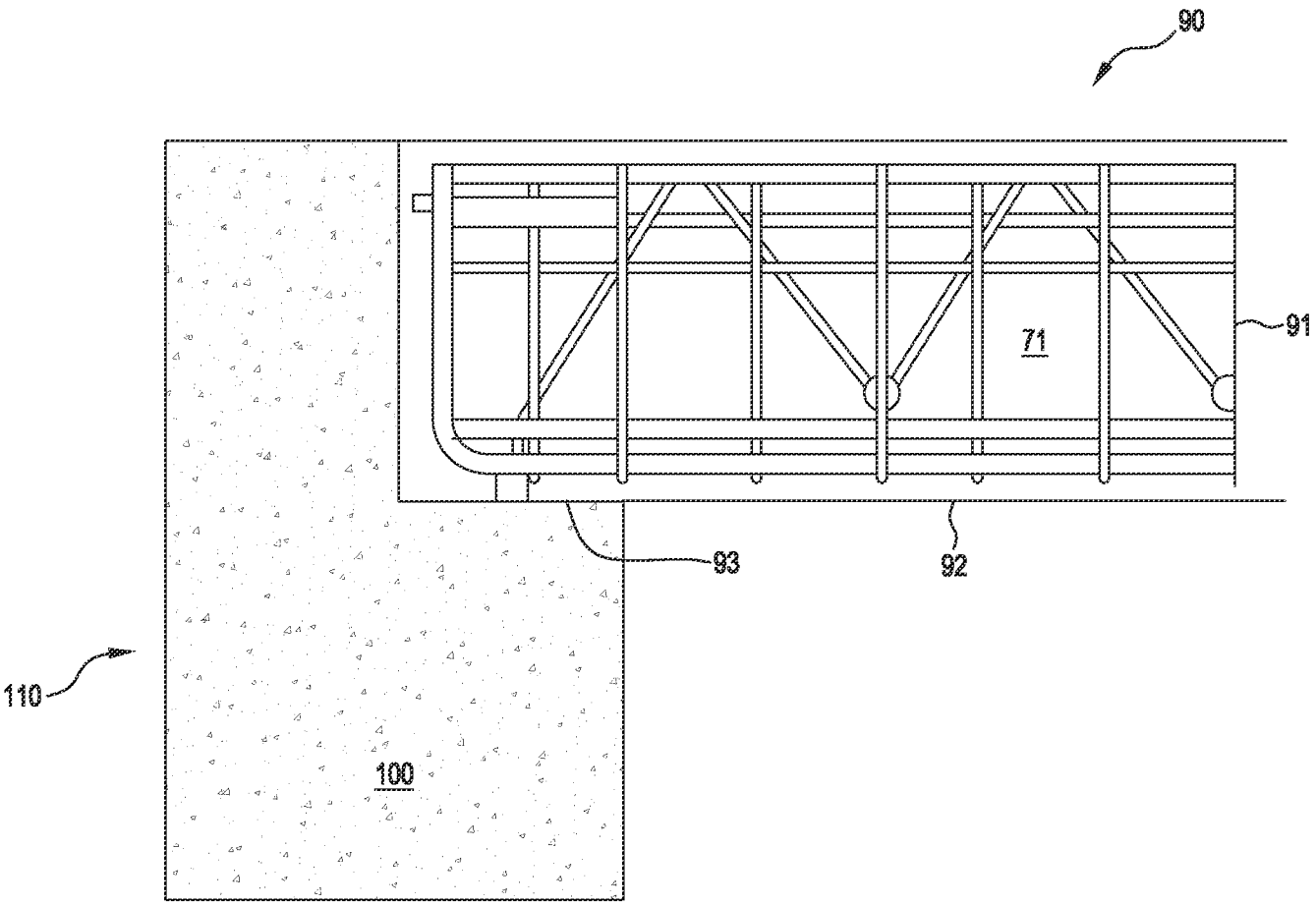
FIG. 13 is a side view of an abutment according to the invention, simultaneously constructed with a deck of a bridge.
Figure 13A:
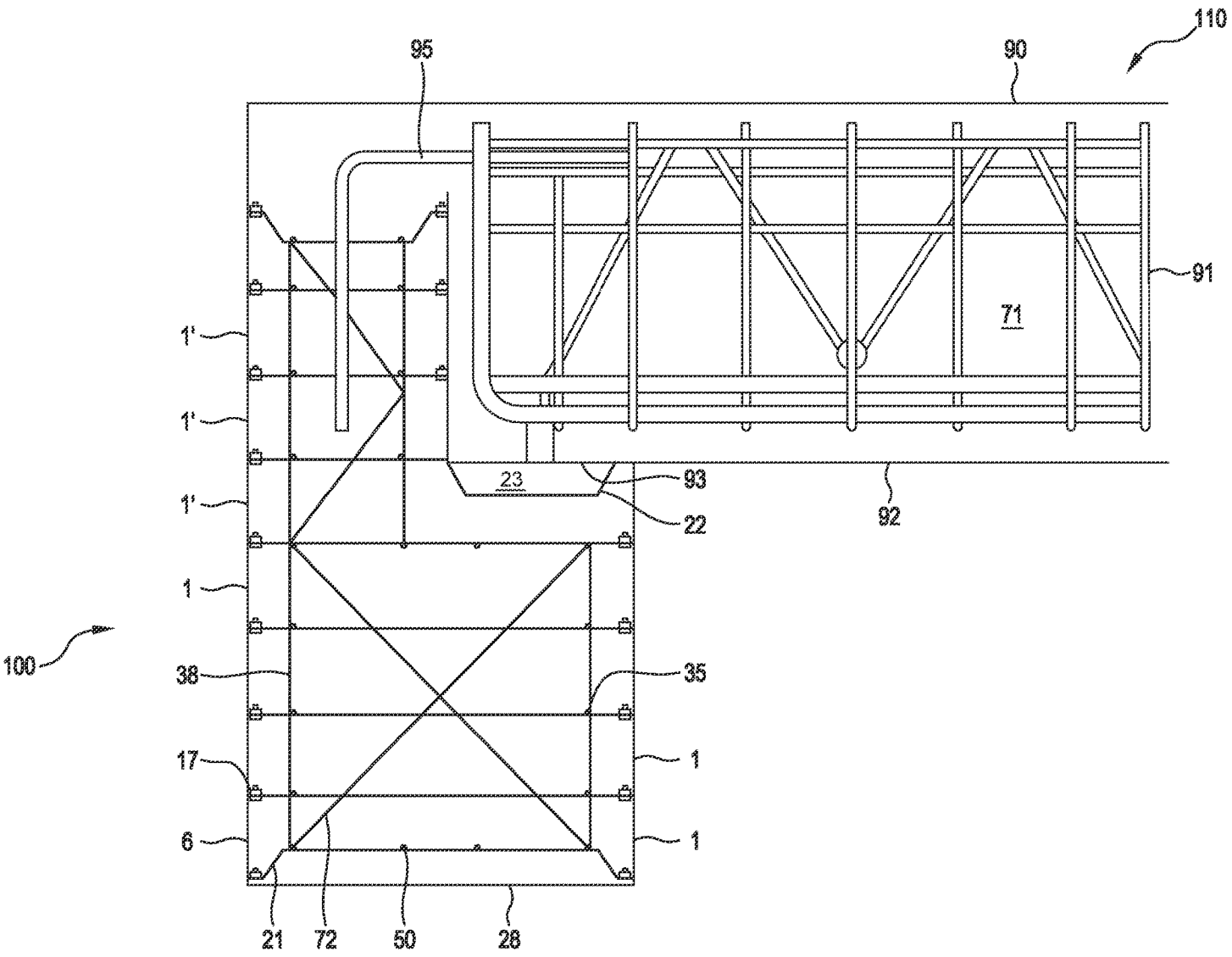
FIG. 13A is a side view of the abutment and deck of a bridge from FIG. 13, prior to binding the two components into a single structure using a settable material.

FIG. 13A illustrates a section through the structure 110 of FIG. 13, illustrating the nesting of a bridge deck 93 upon the abutment 100 according to one embodiment of the invention. To form this structure 110 multiple pours of the settable material 15 can be introduced to strengthen the structure 110 during construction and the interfaces between the abutment 100 and bridge 90 are poured simultaneously, to seamlessly stitch the individual components into the finished structure 110.

The abutment 100 of FIG. 13A is constructed as described herein by co-locating and attaching a plurality of foundation modules 1 together in vertical alignment. The initial four foundation modules 1 in FIG. 13A are of 900 mm width, whereas the successive four foundation modules 1' are of 450 mm width. This reduction in the width of the modules 1' provides a seat 93 for receiving a bottom corner of the bridge 90.

A recessed brace 22 is connected between a side wall 5 of the uppermost 900 mm module 1 and a sidewall 5 of the lowermost 450 mm module 1'. This recessed brace 22 seals the space 10 and forms the seat 91 for receiving a tray 92 of the bridge 90.

The brace 22 is configured to provide not a flat surface but a recessed surface to the seat 93 of the abutment 100. In FIG. 13A the recess provided is approximately 100 mm in depth and thus provides a recess in which to receive the tray 92 of the bridge 90. The recess formed between the tray 92 and the brace 22 can house additional struts 50 to further reinforce the structure 110. In an alternative embodiment, the recessed brace 22 which is bolted or welded, or otherwise joined to the structure can be replaced with a raised brace 21 to provide a protrusion to receive and support the tray 92 of the bridge 90 at a predetermined height.

The bridge 90, illustrated in FIG. 13A comprises the tray 92 which defines a cavity 71 and a reinforcement truss 91 situated within the cavity 71. The tray 92 and truss 91 will be set in position relative to one another when a settable substrate is introduced into the cavity 71. This settable substrate can be the same settable material 15, for example cement or concrete, such that a single pour of the settable material 15 can be used to form both the abutment and the bridge contemporaneously. The cavity 71 of the bridge and the cavity 70 or space 10 of the bridge 90 and the abutment 100 must be in fluid communication to allow the settable material 15 to freely flow around the structure 110. This allows the settable material 15 to set or cure across the entire structure 110 in a single body, thereby avoiding a line of weakness forming between two independent pours of settable material 15 i.e. a first pour to form the abutment and a second pour to form the bridge 90 or a deck 94 thereof.

A further advantage of this invention is that the abutment 100 and bridge deck 94 are not at their full weight until the settable material 15 has been introduced. As such transporting, moving, locating and positioning these components on site do not require the same heavy lifting equipment as that of a typical bridge construction. A corner connector 95 is welded or otherwise connected between the reinforcement truss 91 and the abutment 100 to maintain alignment and location between the abutment and the bridge 90 prior to the introduction of the settable material 15. Once the settable material has set, the corner connector 95 becomes encased in the finished bridge/abutment structure and adds to the overall strength of the finished structure 110.

Additional reinforcements may be incorporated into the internal support 40 in the form of X-braces 72. These X-braces 72 extend diagonally across a number of different modules (four at a time in FIG. 13A) to cross-brace the internal support 40 and additionally reinforce the finished abutment 100. These X-braces 72 further assist in supporting the weight of the bridge 90 when seated on the abutment 100, prior to the introduction of the settable material 15 which provides a large contribution to the structural strength of the finished structure 110.

The abutment 100 can be poured in one pour or alternatively poured to the level of the bearing seat 83 with vertical reinforcement members 38 left protruding through the upper foundation modules 1' (sometimes referred to as a rebate wall) located above the bearing seat 93.

When the bridge tray 92 is positioned on the seat 93 and the settable material 15 filled into the tray 92, the material is also allowed to flow into the abutment 100 allowing for an in-situ connection between the concrete bridge 90 and abutment 100.

There are many advantages of this construction method which provides a stronger and more reliable structure 100. Additional reinforcement members, like the corner connector 95, can be positioned between the abutment 100 and reinforcement truss 91 to allow transfer of loads and forces between the two and thus provide a connection that mimics a continuous span for the bridge deck 94 allowing a greater span of the bridge deck 94, illustrated in FIG. 13B.

Figure 13B:
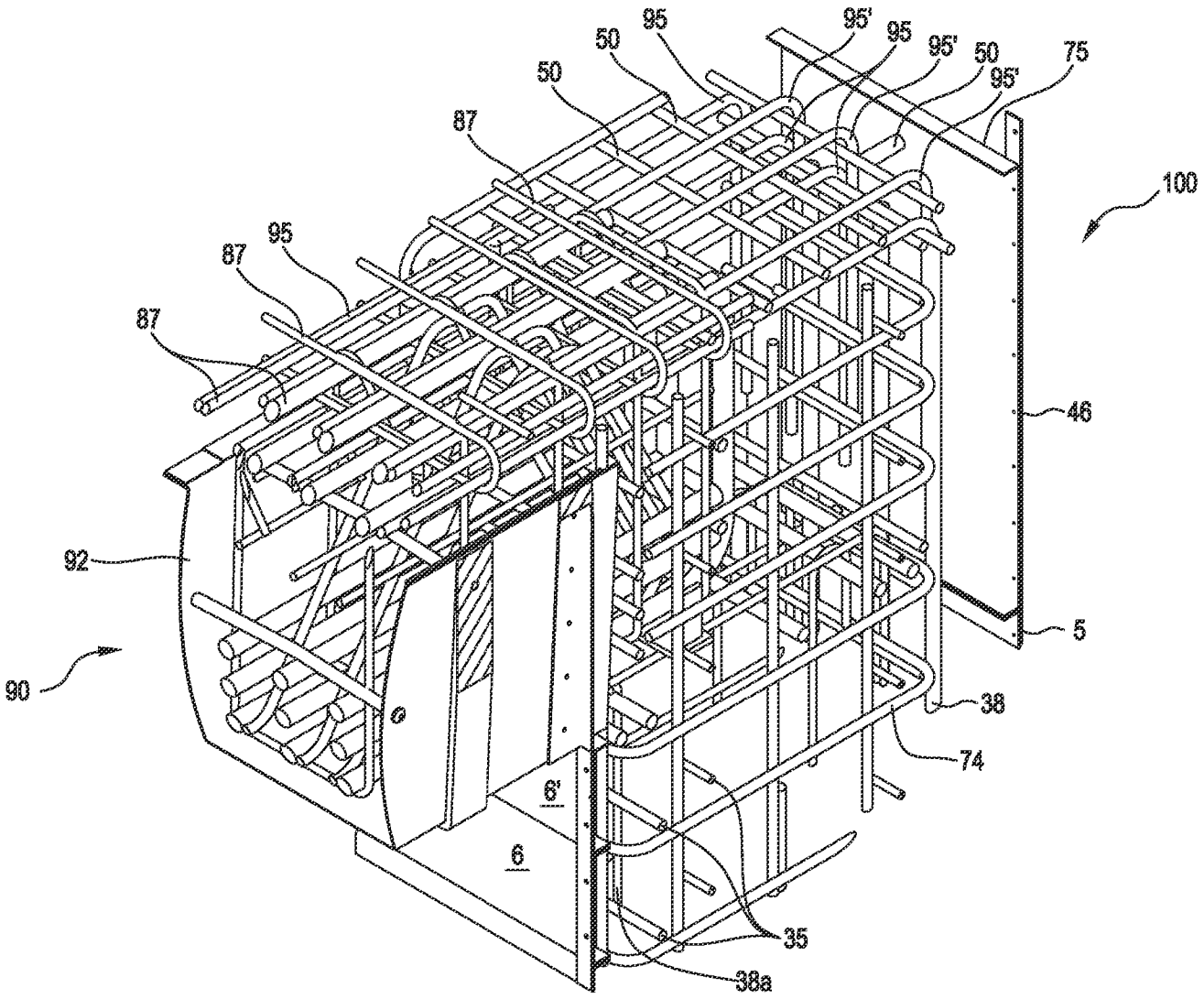
FIG. 13B is a perspective view a section of an abutment and a deck of a bridge from FIG. 13, illustrating an integrated configuration of the reinforcement structure of the deck and the internal reinforcement structure of the abutment, prior to the introduction of a fluid concrete mixture.

A plurality of corner connectors 95 is located between the reinforcement truss 91 of the bridge and the reinforcement cage 30. The connectors 95 are also inserted in a reverse direction 95' to interconnect the second reinforcement members 38 of the abutment 100 with the first 86 and second reinforcement members 87 of the deck 94 of the bridge 90. As illustrated in FIG. 13B, the second reinforcement member 38 extends vertically within the abutment 100 and overlaps with a corner connector 95, directing the loads therein around the corner and into a horizontal direction along the first reinforcement member 86 of the deck 94.

The corner connector 95 also acts as an embedment bar, extending into the abutment 100.

The first reinforcement members 86 are cross-braced by second reinforcement member 87 that perpendicularly intersect the first reinforcement members 86. The second reinforcement members 38 adjacent the deck 84 can be a reduced diameter to those on the outer side of the abutment 100. The reduced diameter members **38*a* extend to meet the integrated corner connectors 95, 95' and can be welded thereto, particularly to the reversed corned members 95' that extend downwards into the abutment 100. The integrated configuration of the reinforcement of the deck and the internal reinforcement cage 30 of the abutment, prior to the introduction of a fluid concrete mixture provides good load transfer between the individual elements of the abutment 100 and the bridge 90. The two elements become integrated into the structure 110** on the introduction and curing of the fluid concrete mix, preferably in a single pour.

Figure 14:
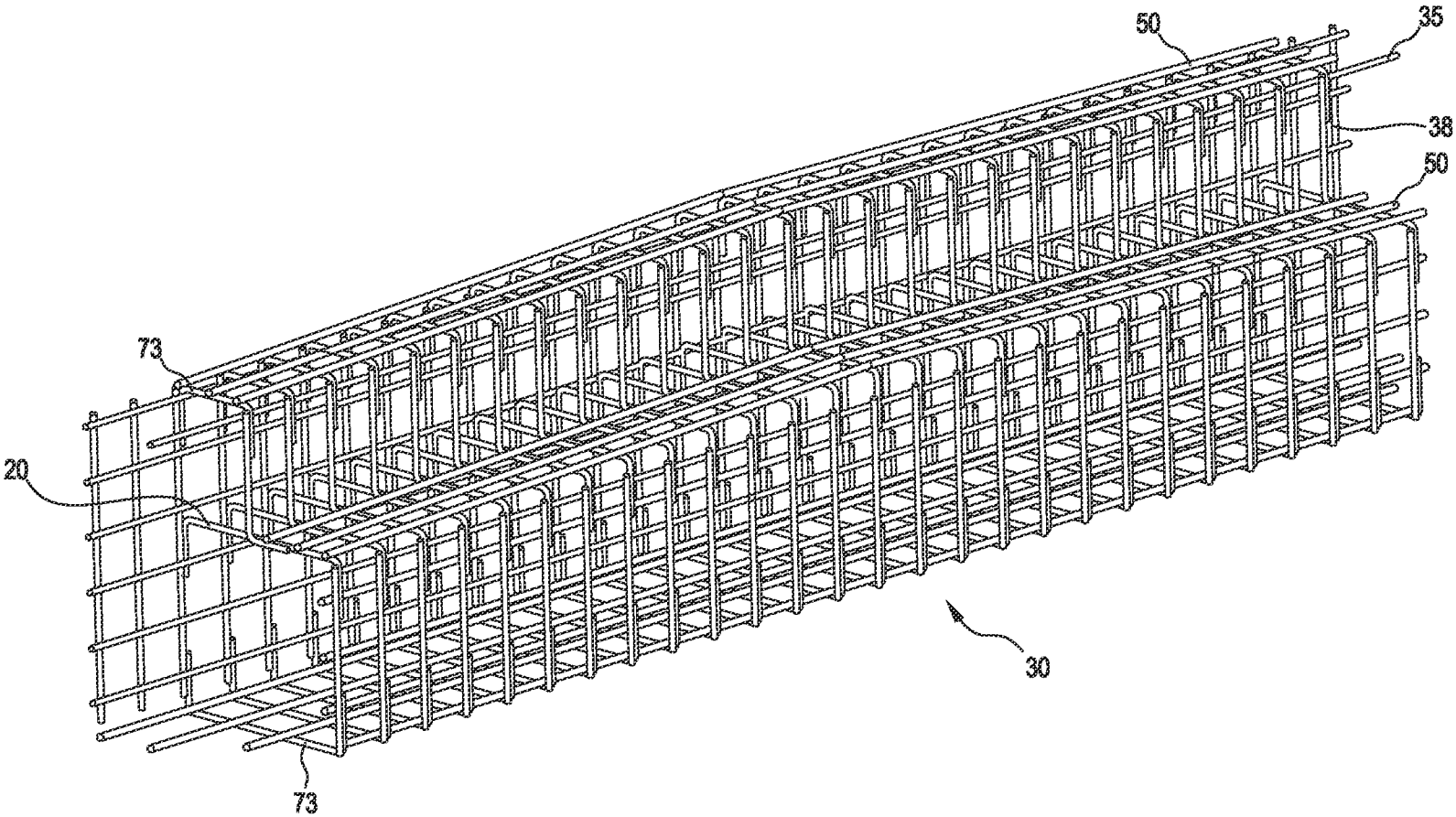
FIG. 14 is a perspective view of part of a reinforcement cage from within a primary wall of the abutment of FIG. 11, without formwork, braces or settable material introduced thereto.

FIG. 14 is a perspective view of part of the reinforcement cage 30 from within the primary wall 80 of the abutment 100 of FIG. 11, without any formwork, braces or settable material introduced thereto.

Figure 14A:
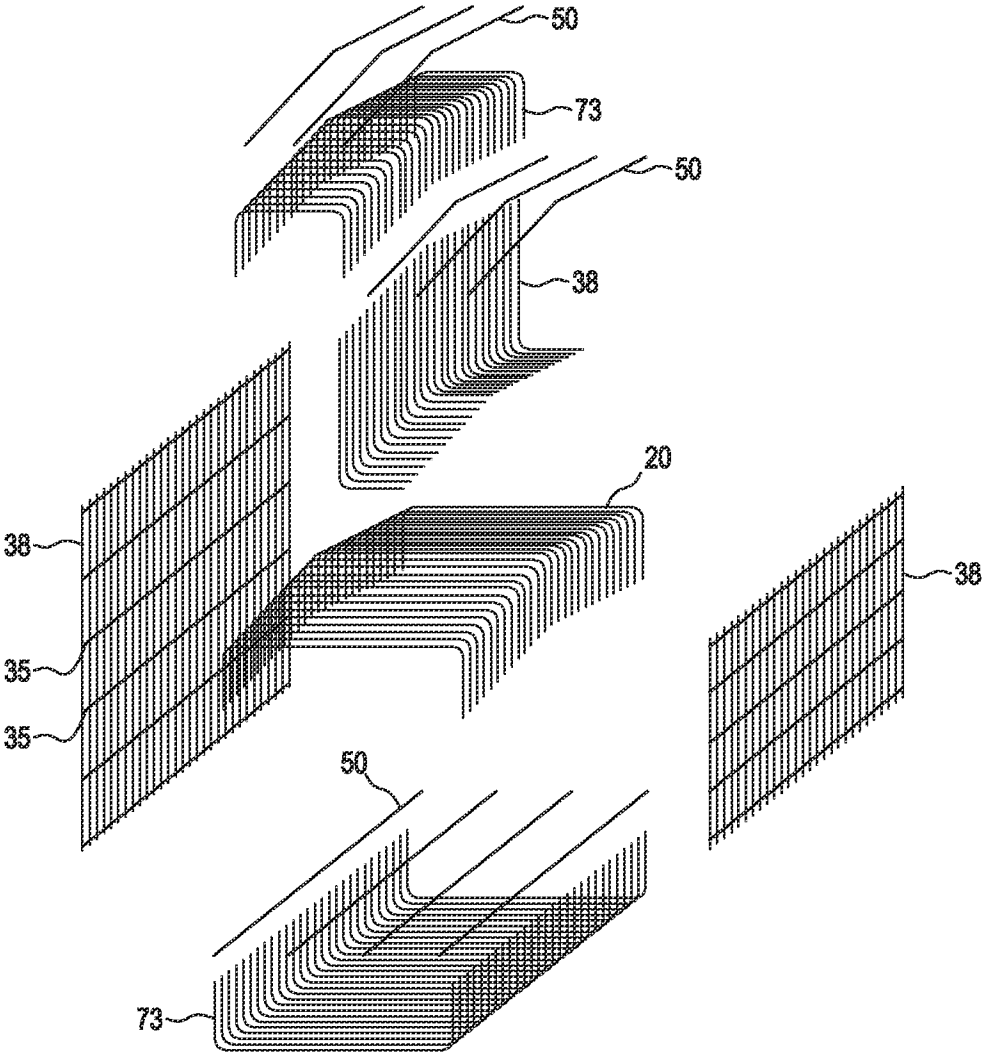
FIG. 14A is an exploded perspective view of the reinforcement cage of FIG. 14, to isolate and identify the individual components of the reinforcement.

FIG. 14A is an exploded perspective view of the reinforcement cage 30 of FIG. 14, to isolate and identify the individual components of the reinforcement. The braces 20 and the side walls 5, 6 are not included in this illustration for clarity.

Figure 15:
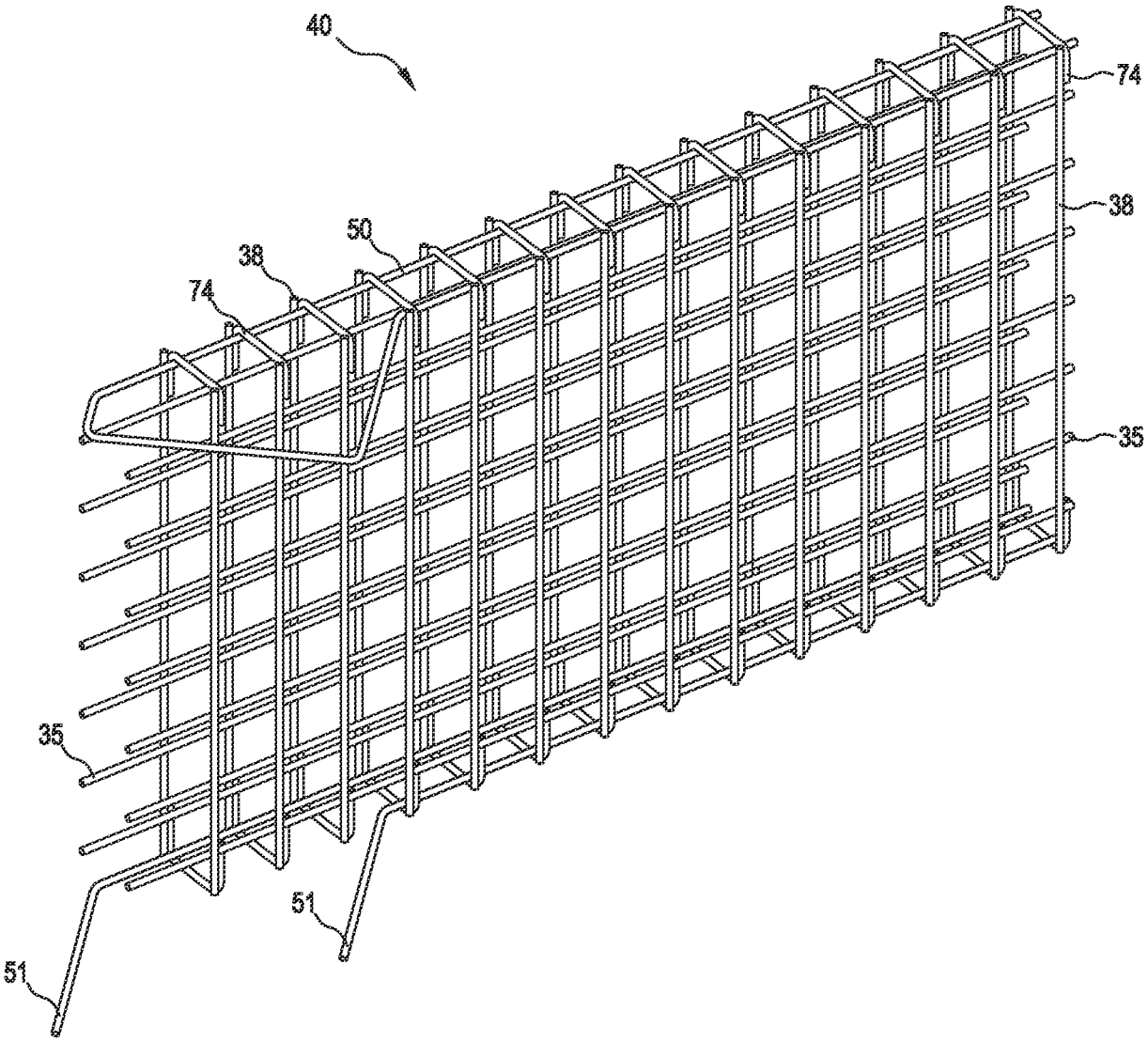
FIG. 15 is perspective view of the internal support from within the wing wall of the abutment of FIG. 11, without any formwork or settable material introduced thereto.

FIG. 15 is perspective view of the internal support from within the wing wall 85 of the abutment 110 of FIG. 11, without any formwork of settable material introduced thereto. The ligatures 74 can be seen binding together the horizontal 35 and vertical reinforcement members 38. Also illustrated protruding from the struts 50 are angled struts 51 which extend from the wing wall 85 at an angle ready for attachment to a primary wall 80 of the abutment 100. The angled struts 51 can be formed in a plurality of different angles depending on the overall configuration of the desired abutment 100.

Figure 16A:
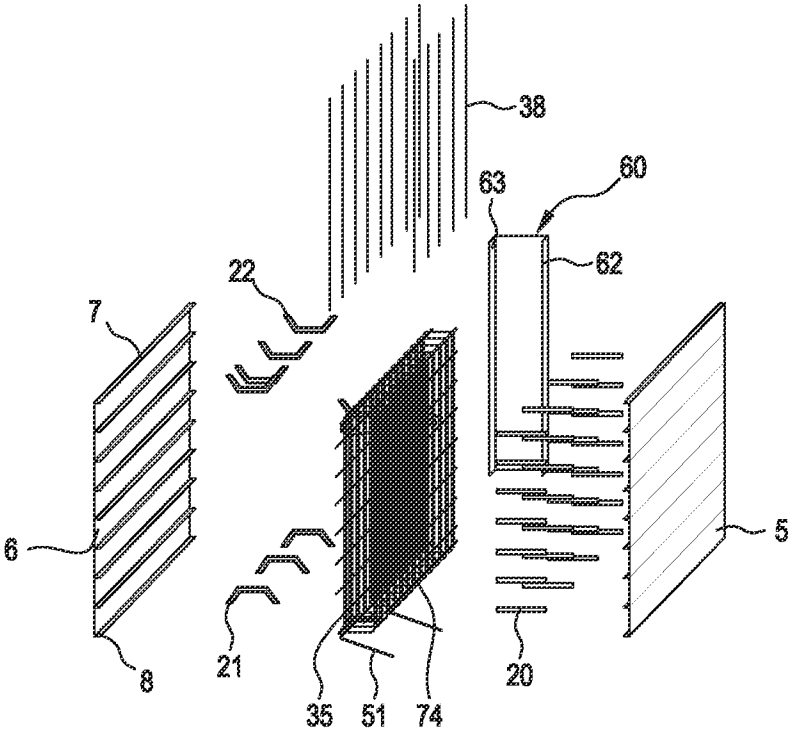
FIG. 16A is an exploded perspective view of the internal support of FIG. 16, to isolate and identify the individual components of the reinforcement.
Figure 16:
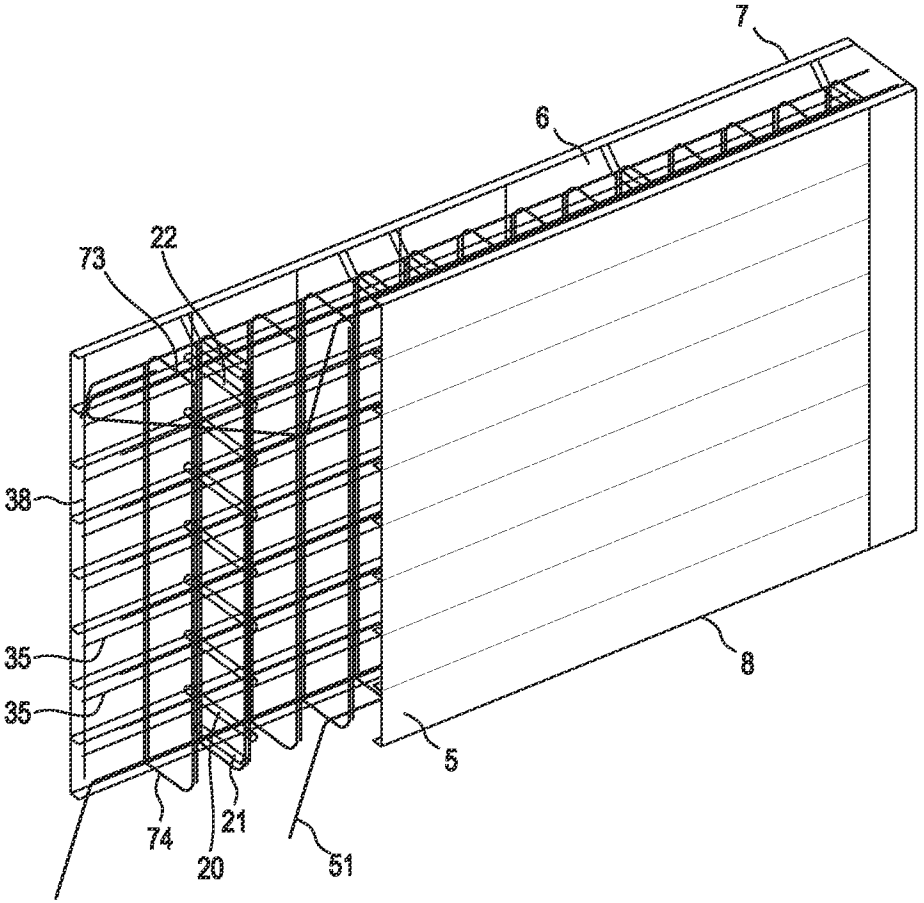
FIG. 16 is perspective view of the internal support from within the wing wall of the abutment of FIG. 15, with formwork panels attached thereto.

FIG. 16 is a perspective view of the internal support 40 from within the wing wall 85 of the abutment 100 of FIG. 15, with formwork panels 5, 6 and braces 20 attached thereto.

FIG. 16A is an exploded perspective view of the internal support 40 of FIG. 16, to isolate and identify the individual components of the reinforcement. The raised braces 21 and recessed braces 22 are clearly seen in this exploded view of FIG. 16A.

Use of Multiple Abutments to Build a Head Stock

Depending on the length or span of bridge 90, it may be necessary to support the bridge 90 at various points across the span. This is typically done using piers 96 (also referred to as piles) which require a head stock 97 to receive and engage the decks 94 of the bridge 90.

Figure 17:
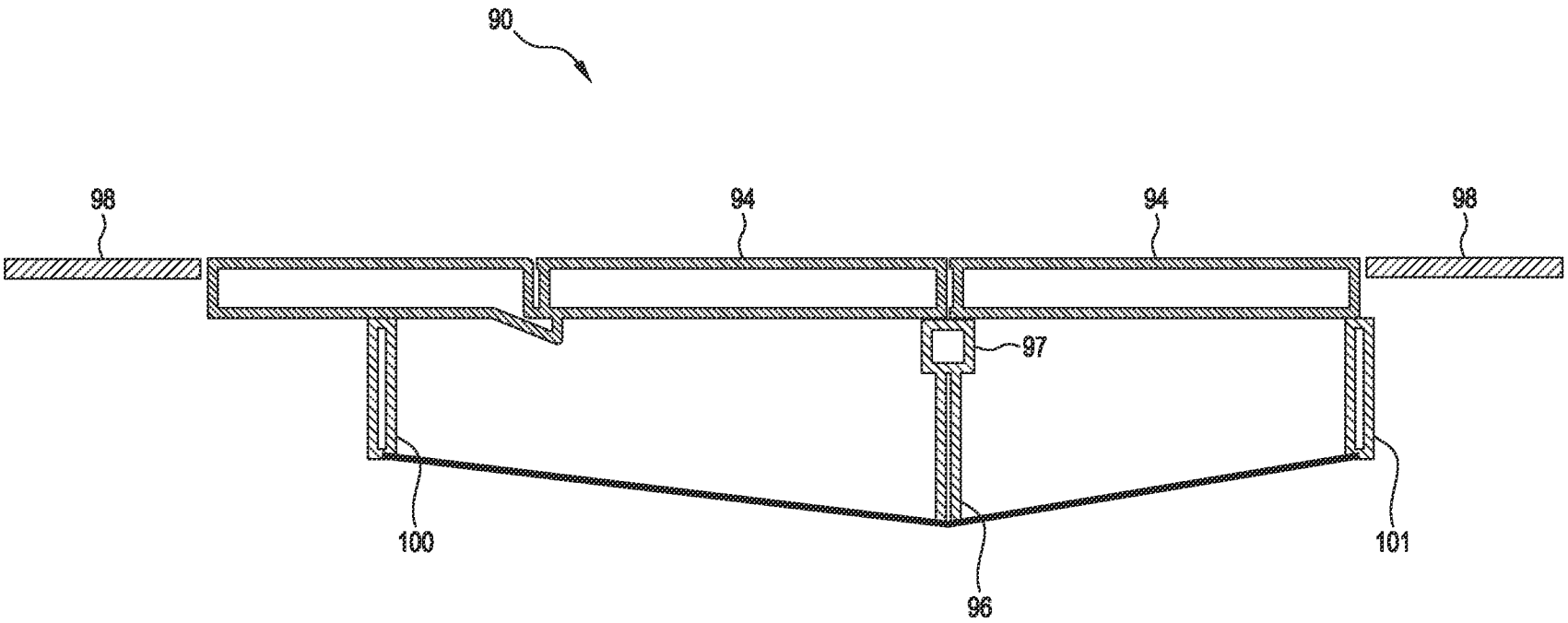
FIG. 17 is a schematic view of a bridge having a central headstock supporting two adjacent decks to form a bridge.

FIG. 17 illustrates a bridge 90 having two decks 94 supported by a headstock 97 that sits atop a pier 96. The headstock 97 comprises a pier cap A and an abutment 100, which is shown in more detail in FIG. 18.

Figure 18:
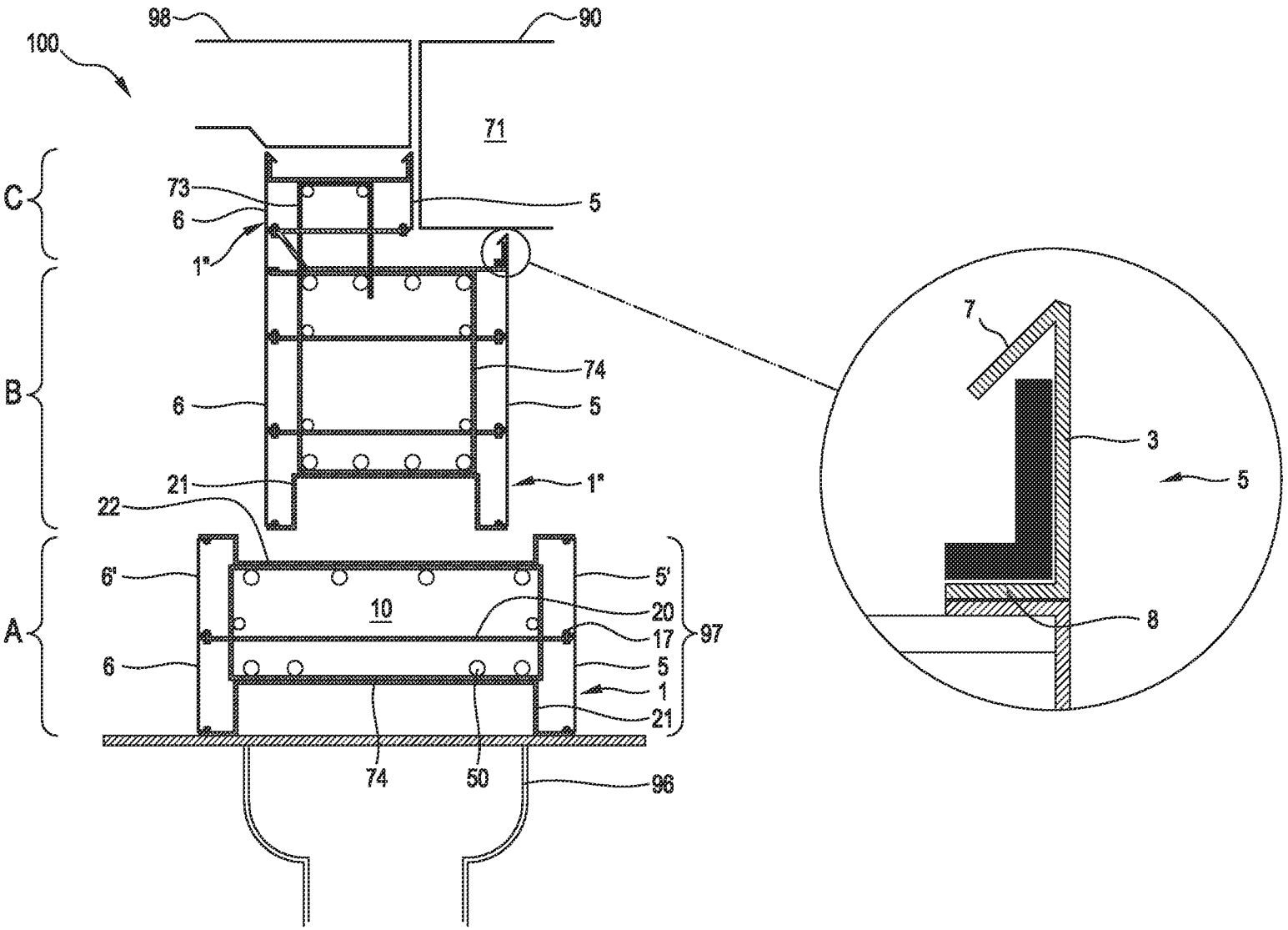
FIG. 18 is a schematic view of a headstock comprising a plurality of abutments formed according to the invention.

FIG. 18 illustrates an embodiment of the invention in which the abutment 100 is formed in three portions A, B and C, each portion comprising a different width of foundation module 1, 1', 1". In FIG. 18, portion A of the abutment 100 may also be referred to as a pier cap, as it effectively caps the pier 96.

In this embodiment the first portion A of the abutment 100 is the widest of the three portions, and comprises a recessed brace 22 configured to have a recess 23 facing inwardly of the abutment portion A. The second portion B of the abutment 100 is received in the recess 23 to provide stability and location before the settable material 15 is introduced into the abutment 100. The second portion B of the abutment is configured to have a raised brace 21 at the base 55 thereof. The raised brace 21 offsets the location of struts 50 within portion B from the base 55 of portion B by about 110 mm.

The uppermost portion C of the abutment 100 is connected to portion B by a U-brace 73 which is employed to anchor the third portion C to an uppermost brace 20 of portion B of the abutment 100. The U-brace 73 can be formed from steel bar or other structural material with sufficient load bearing capacity. The bar of U-brace 73, as illustrated in FIG. 18 has a diameter of between 8-20 mm.

For clarity the modules of portion A will be referred to as modules 1, the modules of portion B will be referred to as module 1' and the module of portion C will be referred to as module 1".

The side walls 5, 6 of module 1" of portion C of the abutment have upper flanges 7" turned in by approximately 45 degrees, to ensure that these flanges 7" do not extend past the abutment 100 and cause problems when interfacing with the tray 92 or road 98 to be situated thereon.

The larger portions A and B of the abutment are not cross-braced in this embodiment but instead the internal support comprises ligatures 74 which encircle and bind the groups of modules 1 together (and additional ligatures 74 to bind the groups of modules 1' together). The ligatures 74 are made from a strong material such as steel or similar and may be configured as rods, bars, straps or belts. The ligatures 74 of FIG. 18 are illustrated as steel bars approximately 12 mm diameter; however, the specification of the ligatures 74 will vary according to the structure 110 to be supported and the load to be supported. The ligatures 74 can be welded, bolted or bonded to at least one of the braces 20, the horizontal members 35, and the vertical members 38 within each of portions A and B of the abutment 100. In some embodiments the ligatures 74 are bound around groups of members within the cage 30 to further bind together and reinforce the cage 30. The ligatures 74 can be formed of a continuous member and constitute an additional component to the internal support 40. Alternatively, a ligature 74 can be effectively formed by welding or otherwise coupling a pair of U-braces 73 to opposing ends of a pair of vertical reinforcement members 38. The extent of required reinforcement will determine which form of ligature is incorporated into the internal support 40.

In some embodiments (see for example FIG. 20) ligatures 74 are formed from a plurality of U-braces 73 coupled to the vertical reinforcement members 38 of both the top 54 and the bottom 55 of the abutment 100.

As the ligatures 74 are configured to encircle the support structure 40 within each portion of the abutment 100 they assist in resisting the bending or bowing of these components away from each other when loaded. Like the remainder of the support structure 40 within the abutment, the ligatures 74 will become encased in the abutment 100 once the settable material 15 has been introduced and set within the space 10, thereby further internally reinforcing the abutment 100.

In essence, the ligatures 74 are reinforcement straps that are entwined or wrapped around the vertical members 38 and horizontal members 35 of the reinforcement cage 30. The ligatures 74 can be connected by looping and overlapping horizontal members 35 and looping down onto the vertical members 38 and the brace 20 that connect the opposing formwork members 4.

The first portion A of the abutment 100 may be referred to as a pier cap and can be mounted, bolted or otherwise secured to the pier 96. This provides a stable support for the remaining portions B and C of the abutment 100 and allows the formation of a single space 10 for receiving the settable material 15, if required, in a single pour.

Figure 19:
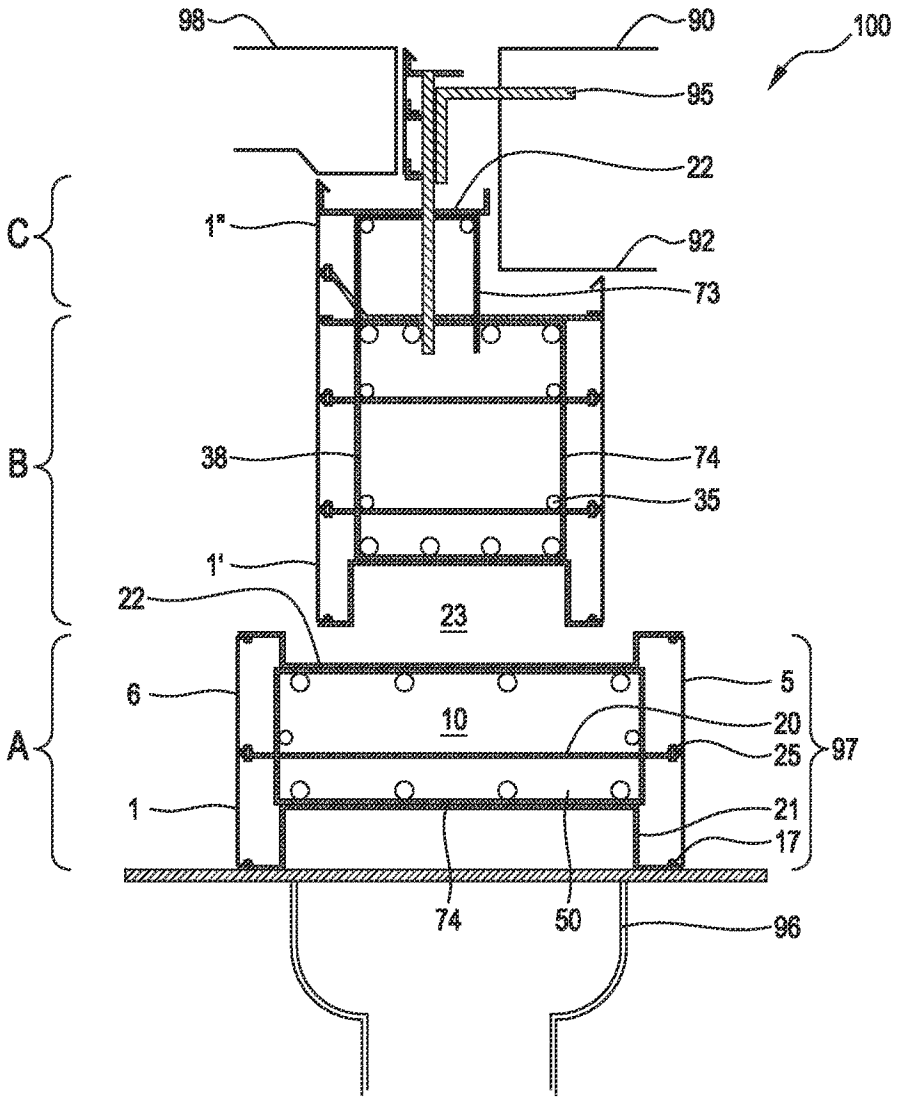
FIG. 19 is a schematic view of a headstock comprising an abutment configured as a pier cap and secondary abutment according to the invention.

FIG. 19 illustrates an alternative headstock 97 comprising a pier cap A and an abutment 100 (portions B and C), which utilises a corner connector 95 to retain the bridge deck 94 to the headstock 97 while in position on the pier 96 to receive the settable material 15.

Figure 20A:
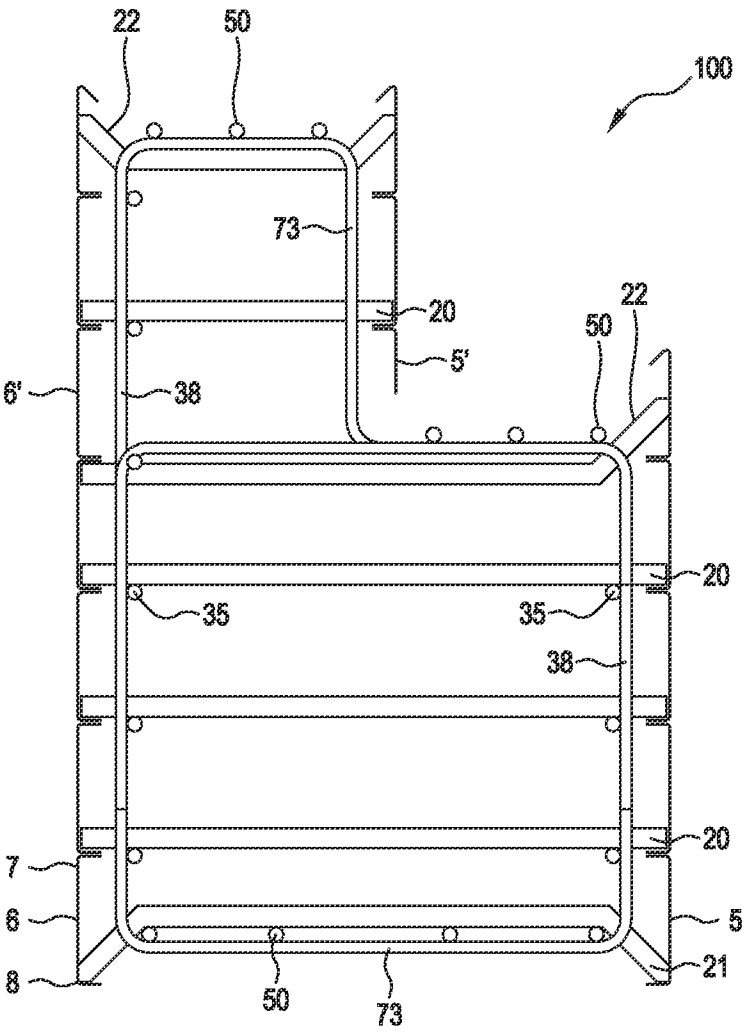
FIG. 20A is a cross-sectional view of the primary wall abutment of FIG. 20.
Figure 20:
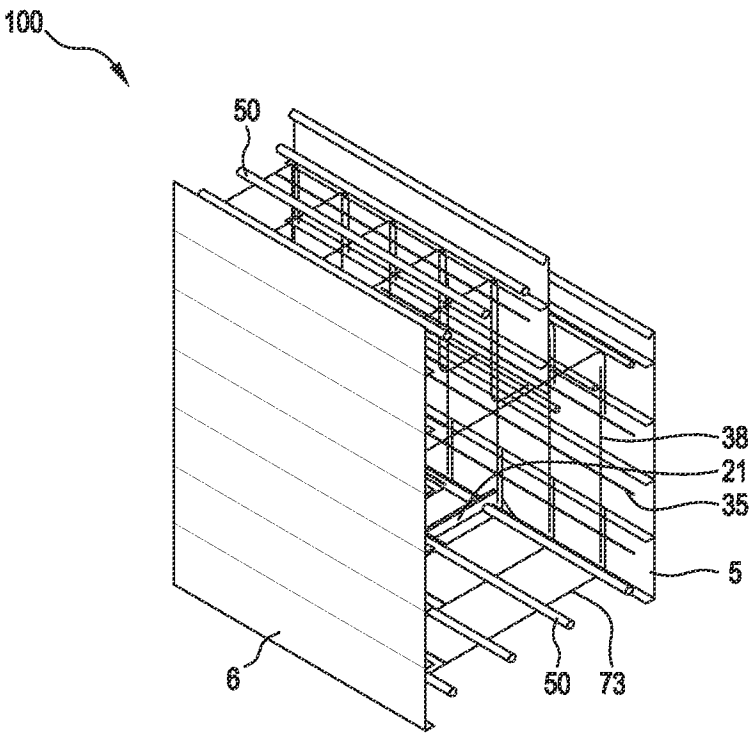
FIG. 20 is a perspective view of a section of a primary wall of an abutment according to the invention.

FIG. 20 and FIG. 20A illustrate a perspective view and a cross-sectional view of a portion of the primary wall 80 of an abutment 100, respectively. In this embodiment of the invention, the vertical reinforcement members 38 are topped and tailed with U-braces 73 to form circular ligatures 74 around the reinforcement cage 30 of the abutment 100. The horizontal reinforcement members 35, the vertical reinforcement members 38, and the braces 20, 21, 22 are mutually perpendicular to each other within the space between the side walls 5, 6.

Figure 21A:
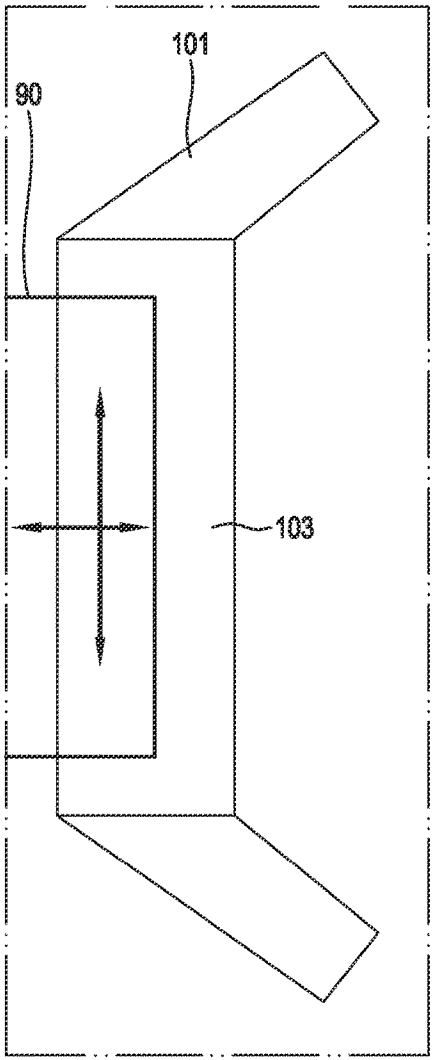
FIG. 21A is a schematic view of the freedom of movement directions of the end of the bridge not attached to the abutment, of FIG. 13.
Figure 21:
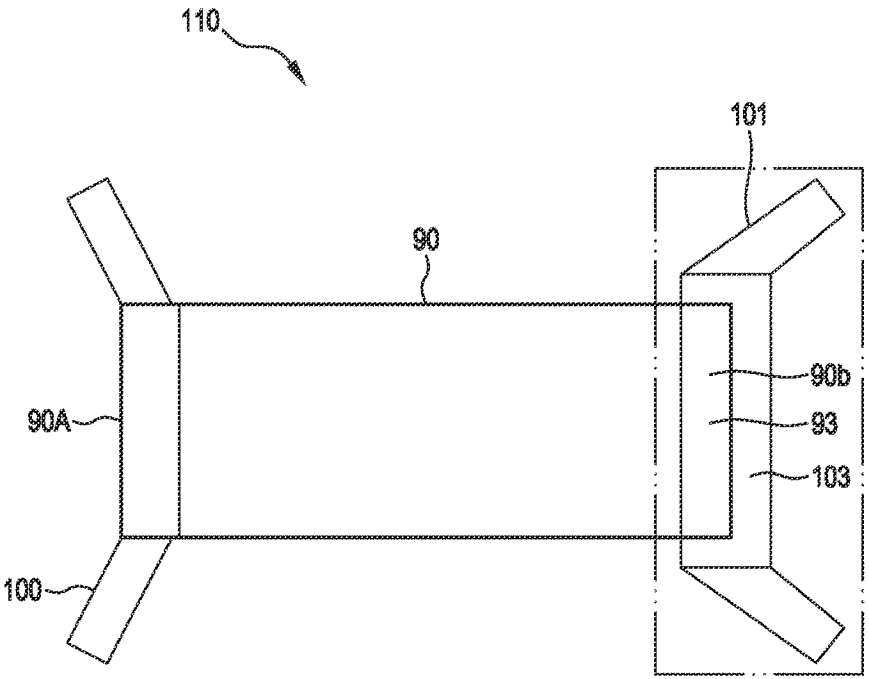
FIG. 21 is a schematic view of a bridge and two abutments, one abutment secured to the bridge and a second abutment not attached to the bridge.

While there are structural benefits to simultaneously forming the bridge 90 with the abutment 100 it is further contemplated that in some embodiments only one end 90*a* of the bridge 90 will be constructed in this manner. The second, opposing end 90*b* of the bridge 90 may be left unconnected to the abutment 101, as illustrated in FIG. 21.

This floating end 90*b* allows the bridge 90 to move independently of the abutment 101. In geographical areas that are prone to earthquakes and other forms of natural disaster a bridge that is rigidly connected at both ends may sustain greater damage during an earthquake as the bridge 90 and supporting abutments 100 do not offer any flexibility and provide a very rigid structure 110. By removing rigid connections from one end 90*b* of the bridge 90 this end 90*b* becomes a floating section. The floating section may slide over the abutment 101 to better absorb or dissipate energy from an earthquake (see FIG. 21A, where two perpendicular arrows represent the two primary directions of movement of the floating end 90*b*). This provides the opportunity to reduce and maybe even avoid cracking and other structural damage to the bridge 90 depending on the severity of the earthquake or natural disaster.

A further advantage of this embodiment of the invention is to reduce maintenance of the finished bridge 90 by eliminating the need for a bearing between the abutment 100 and bridge deck 94.

The settable material 15 of the abutment 100 can be poured into the bridge decks 94 on both sides for many applications. Removing the need for bridge bearings and providing greater resistance against uplift and horizontal forces that occur during flooding.

The settable material 15 can be poured into the abutment 100 and the bridge deck 94 on one side 90*a* of the bridge that gives a strong connection allowing the opposite side 90*b* to move freely when earthquakes occur. The unconnected abutment 101 will preferably provide a flat shelf 103 that supports and allows the bridge deck 94 to slide thereon. The flat abutment surface 103 will provide a predetermined area for the bridge deck 94 to slide that will ideally correspond with the earthquake risk and possible ground shift for a given location. For instance if an earthquake risk could cause a ground shift of 240 mm in one direction then the abutment surface 103 could provide at least 480 mm of sliding surface. When an earthquake occurs, the bridge deck 94 will slide and the road surface made of a compacted material could be pushed away and be easily repaired.

In further consideration of structures to be erected in earthquake zones, it is contemplated that the settable material 15 can be introduced into the space 10 of a module 1 in multiple pours, inter-dispersed with a second settable material 16. The first settable material 15 can be poured into the space 10 to only fill a portion of the space 10 and left to set. This first material 15 may be concrete or cement. A secondary settable material 16 is then introduced into the space 10 having better damping characteristics, such as a composite material comprising some form of rubber or elastic material. This second pour need only leave a thin layer of material, essentially a barrier between the first and third pour of settable material to allow the finished abutment 100 to better absorb energy form an earthquake. A third and final pour of the first settable material 15 is then introduced to fill the space 10 and complete the abutment 100. Ideally the layer of the second settable material 16 should not coincide with a joint between vertically successive side walls 5, 6.

Having a layer of dampening material 16 within the abutment 100 may also reduce the propensity for the abutment 100 to crack under heavy and/or repeated loading during use.

Figure 22A:
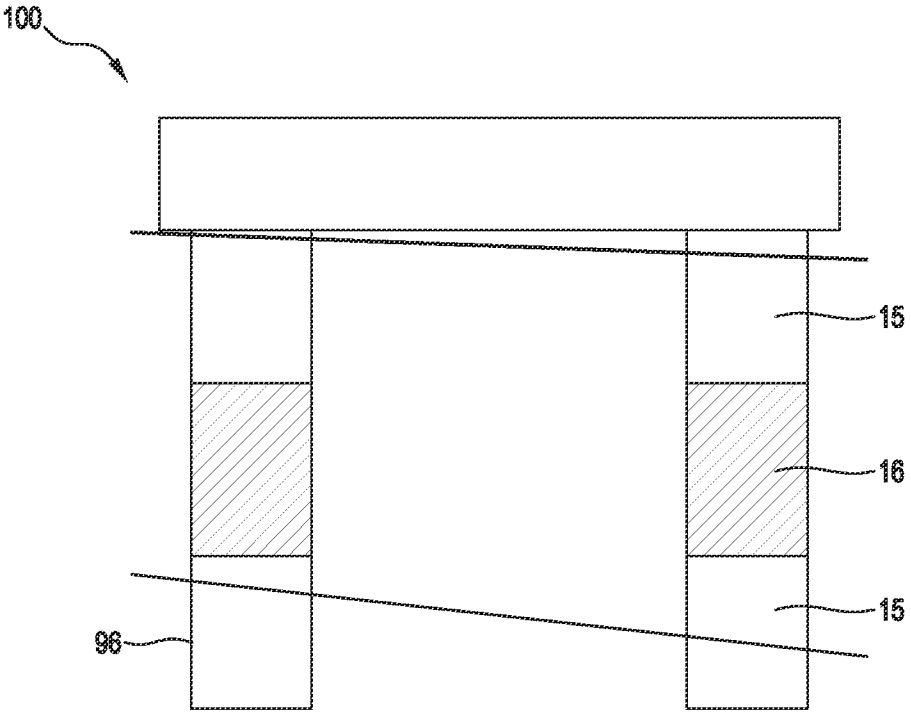
FIG. 22A is a schematic view of a pair of piers according to FIG. 22 supporting a horizontal abutment.
Figure 22:
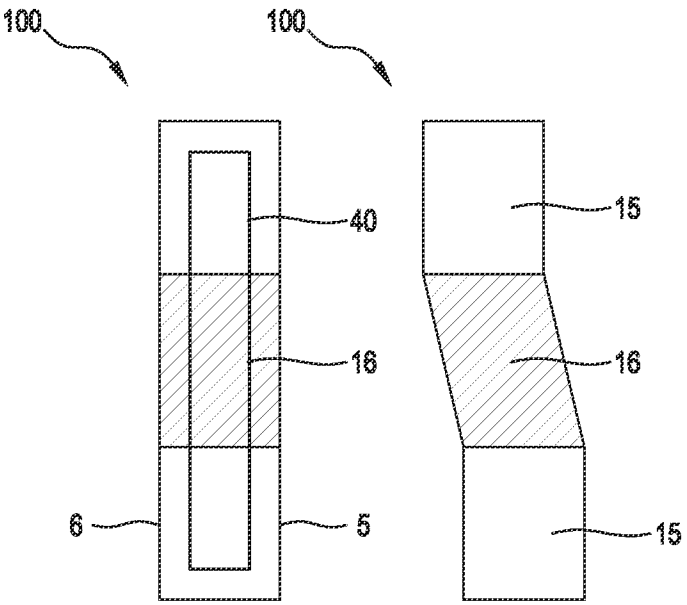
FIG. 22 is a schematic view of an abutment configured as a pier, wherein a secondary settable material has been introduced into the pier allowing a degree of damped movement between the upper and lower portions of the pier.

FIGS. 22 and 22A are a schematic representation of a module 1 as described above, illustrated as a pier 96. The pier 96 is essentially an abutment having a greater height dimension than either of its depth or width. The pier 96 of FIG. 22 has been formed according to the invention. The pier 96 having an internal support structure 40, a pair of side walls 5, 6 and three separate pours of two settable materials 15,16,15 to produce internal layers within the space 10, the second layer 16 damping movement between the first layer 15 and the third layer 15.

It is further contemplated that the three pours could each comprise a different settable material, to further tailor the mechanical properties of the finished peer 96.

Method of Forming a Foundation Module

The invention also provides a method of constructing a foundation module 1, the method comprising the steps of: (i) coupling a pair of side walls 5,6 to a brace 20, to hold the side walls 5,6 in spaced apart relationship forming a space 10 therebetween; (ii) constructing a three dimensional reinforcement cage 30 by positioning a pair of first members 38 perpendicular to the brace 20 within the space 10 and securing the first members 38 to the brace 20, and positioning a pair of second members 35 within the space 10 parallel to the pair of side walls 5,6, wherein the cage 30 forms an internal support 40 within the space 10 between the side walls 5,6; and (iii) introducing a settable material 15 into the space 10 to integrate the internal support 40 with the side walls 5,6 as the settable material 15 sets, to form the foundation module 1.

For additional support a second brace 20 can be secured to the side walls 5, 6 spaced apart from the first brace 20.

The braces 20 can be welded to the side walls 5, 6 or bolted into position in situ. It is further contemplated that the brace 20 and side walls 5, 6 could be adhered to one another to form a discrete or a continuous joint condition.

A selection of formwork panels 4 are selected to extend to a predetermined length of the foundation required. The formwork panels 4 form a pair of side walls 5, 6. Each of the side walls 5, 6 are engaged to a brace 20, at opposing ends of the brace 20. Many mechanical engagement methods can be used e.g. bolting, pinning, welding, and adhesives. In some embodiments, the brace 14 is formed having cylindrical protrusions 25 for dropping into receiving holes within the side walls 5,6 (as illustrated in FIGS. 3C and 7E) eliminating the need for additional mechanical fixings.

Once both side walls 5, 6 are secured to the brace 20 a space 10 is formed between the side walls. The ground on which they are resting provides a third side to the space 10 to form a cavity 70. A pair of vertical reinforcement members 38 is introduced into the space parallel to both the side walls 5, 6 and the brace 20. The vertical reinforcement members 38 can be slotted into the brace 20, or slid through the brace 20 or simply welded thereto, depending on the form of the brace 20 used.

In some embodiments more than two vertical reinforcement members 38 are used in each foundation module 1 to provide additional strength to the internal support 40.

A pair of horizontal reinforcement members 35 is then placed into the space 10 longitudinally i.e. parallel to the side walls and perpendicular to the brace 20. The horizontal reinforcement members 35 can be fixed to the brace 20 or to the vertical reinforcement members 38 or both. Alternatively the horizontal reinforcement members 35 can simply lie on the brace 20.

At this time additional struts 50 can be laid across the brace 20 to provide additional load bearing capacity to the finished module 1.

The settable material 15 is then be added to the space 10 in a pourable form, such that it engulfs the internal support 40 and flows around the space 10. When introduced to the space 10 the settable material 15 will displace the horizontal reinforcement members 35, if not fixed in place; however, gravity will keep the members 35 parallel to the side walls 5, 6 and the brace 20 will prevent them from being vertically displaced.

As the settable material 15 sets, the side walls 5, 6 the brace 20 and the horizontal reinforcement members 35 and vertical reinforcement members 38 (the internal support 40) will be joined and integrated with the settable material to form the foundation module 1.

Abutment Construction Method Using Foundation Modules

According to a further aspect of the invention, there is provided a method of constructing an abutment 100 using a plurality of foundation modules 1,1', the method comprising the steps of: (i) coupling a pair of side walls 5, 6 to a brace 20, to hold the side walls 5, 6 in spaced apart relationship forming a space 10 there between; (ii) constructing a three dimensional reinforcement cage 30 by: (a) positioning a pair of first members 38 perpendicular to the brace 20 within the space 10 and securing the first members 38 to the brace 20, wherein the first members 38 extend beyond the pair of side walls 5, 6, and (b) positioning a pair of second members 35 within the space 10 parallel to the pair of side walls 5, 6, (iii) coupling a successive pair of side walls 5', 6' to the side walls 5,6 and engaging the successive side walls 5', 6' with a successive brace 20'; (iv) coupling the successive brace 20' to the first members 38 of the reinforcement cage 30; (v) positioning a successive pair of second members 35' within the space 10 parallel to the successive side walls 5', 6', such that the cage 30 forms an internal support 40 within the space 10 between the side walls 5, 6 and successive side walls 5', 6'; and (vi) introducing a settable material 15 into the space 10 to integrate the internal support 40 with the side walls 5, 6 and successive side walls 5', 6' as the settable material 15 sets, to form the abutment 100.

The abutment 100 is constructed vertically upwards, the pair of vertical reinforcement members 38 (also referred to as uprights) determining the overall height of the finished abutment 100 and the brace 20 determining the overall width of the abutment 100.

A selection of formwork panels 4 are selected to extend to a predetermined length of the foundation required. The formwork panels 4 form a pair of side walls 5, 6. Each of the side walls 5, 6 are engaged to a brace 20, at opposing ends of the brace 20. Many mechanical engagement methods can be used to couple the brace 20 to the side walls 5, 6 e.g. bolting, pining, welding, and adhesives. In some embodiments, the brace 20 can be formed to have cylindrical protrusions 25 for dropping into receiving holes 45 within the flanges 7, 8 of the side walls 5, 6 (as illustrated in FIG. 7E) eliminating the need for additional mechanical fixings.

Once both side walls 5, 6 are secure to the brace 20 a space 10 is formed between the side walls. The ground on which the side walls 5, 6 are resting provides a third side to the space 10 to form a cavity 70. A pair of vertical reinforcement members 38 is introduced into the space 10 parallel to both the side walls 5, 6 and the brace 20. The vertical reinforcement members 38 can be slotted into the brace 20, or slid through the brace 20 or simply welded thereto, depending on the form of the brace 20 used.

The vertical reinforcement members 38 are longer than the height of the side walls 5, 6, such that the vertical reinforcement members 38 extend beyond the side walls 5, 6. In this manner the vertical reinforcement members 38 interconnect any successive foundation modules 1' formed thereon, as they extend vertically through the reinforcement cage 30 of the entire abutment 100. Each new foundation module 1 is essentially constructed in layers using the vertical reinforcement members 38 as a pair of shared supports.

In some embodiments more than two vertical reinforcement members 38 are used in each foundation module 1 to provide additional strength to the internal support 40.

A pair of horizontal reinforcement members 35 is then placed into the space 10 longitudinally i.e. parallel to the side walls 5, 6 and perpendicular to the brace 20. The horizontal reinforcement members 35 can be fixed to the brace 20 or to the vertical reinforcement members 38 or both. Alternatively the horizontal reinforcement members 35 can simply lie on the brace 20.

At this time additional struts 50 can be laid across the brace 20 longitudinally, to provide additional load bearing capacity to the finished abutment 100.

A successive pair of side walls 5', 6' are then respectively located on top of the side walls 5, 6 such that the upper flanges 7 of the side walls 5, 6 abut the lower flanges 8 of the side walls 5', 6'. The side walls 5, 6, 5', 6' can be bolted or welded to one another. Alternatively, a successive brace 20' is engaged with the abutting flanges 7, 8 of the side walls 5, 6, 5', 6' thereby joining side walls 5, 5' to the brace 20 at a first end of the brace and joining side walls 6, 6' to an opposing end of the brace 20.

The successive brace 20' can comprise holes 24 or slots to receive and/or locate the brace 20 with the two vertical reinforcement members 38, adding a second layer of foundation module 1' vertically aligned with module 1. This method can be repeated to keep engaging successive side walls and successive braces with the two vertical reinforcement members 38 until the desired height of abutment 100 is created.

In some embodiments of the invention, end walls 60, 61 can be welded or bolted to the ends of the formwork 4 to convert the space 10 into a cavity 70.

The settable material 15 is then added to the space 10 (or cavity 70) in a pourable form, such that it engulfs the internal support 40 and flows around the space 10. When introduced to the space 10 the settable material 15 will displace the horizontal reinforcement members 35, if not fixed in place; however, gravity will keep the members 35 parallel to the side walls 5, 6 and the brace 20 will prevent them from being vertically displaced.

As the settable material 15 sets, the side walls 5, 6, 5', 6', the braces 20, 20' and the horizontal reinforcement members 35, 35' and vertical reinforcement members 38 (the internal support 40) will be joined and integrated with the settable material 15 to form the unitary abutment 100.

As the space 10 increases in volume, so too does the amount of settable material 15 required to fill the space 10 and therefore, the forces acting internally against the side walls 5, 6, 5', 6'. While additional braces 20 can be incorporated into each module 1 of the abutment, so too can additional horizontal reinforcement members 35. To support the additional loads the internal support 40 may also comprise an increased number of vertical reinforcement members 38 within each module 1.

As illustrated in FIGS. 11-13, X-braces 72, corner connectors 95, and ligatures 74 can be incorporated into the internal support 40, prior to the introduction of the settable material 15. This will assist the finished abutment 100 in resisting loads in a number of different load cases: bending, bowing, buckling and the like.

Method of Forming an Abutment and Bridge Contemporaneously

The invention further provides a method of constructing a foundation module 1 and a bridge 90 contemporaneously, the method comprising the steps of: (i) coupling a pair of side walls 5, 6 to a brace 20, to hold the side walls 5, 6 in spaced apart relationship forming a space 10 therebetween; (ii) constructing a three dimensional reinforcement cage 30 by positioning a pair of first members 38 perpendicular to the brace 20 within the space 10 and securing the first members 38 to the brace 20, and positioning a pair of second members 35 within the space 10 parallel to the pair of side walls 5, 6, wherein the cage 30 forms an internal support 40 within the space 10 between the side walls 5, 6; (iii) supporting a portion of a bridge 90 upon the three dimensional cage 30, the bridge 90 comprising a tray 92 defining a cavity 71, including a reinforcement truss 91 situated within the cavity 71, such that the cavity 71 is in fluid communication with the space 10; and (iv) introducing a settable material 15 into both of the space 10 and the cavity 71 to simultaneously integrate the internal support 40 with the side walls 5, 6 of the foundation module 1 and integrate the truss 91 with the tray 92 of the bridge 90 as the settable material 15 sets, to form a unitary foundation module and bridge structure 110.

A selection of formwork panels 4 are selected to extend to a predetermined length of the foundation required. The formwork panels 4 form a pair of side walls 5, 6. Each of the side walls 5, 6 are engaged to a brace 20, at opposing ends of the brace 20. Many mechanical engagement methods can be used e.g. bolting, pining, welding, and adhesives. In some embodiments, the brace 20 can be formed to have cylindrical protrusions for dropping into receiving holes within the side walls 5, 6 (as illustrated in FIG. 7E) eliminating the need to additional mechanical fixings.

Once both side walls 5, 6 are secure to the brace 20 a space 10 is formed between the side walls. The ground on which they are resting provides a third side to the space 10 to form a cavity 70. A pair of vertical reinforcement members 38 is introduced into the space parallel to both the side walls 5, 6 and the brace 20. The vertical reinforcement members 38 can be slotted into the brace 20, or slid through the brace 20 or simply welded thereto, depending on the form of the brace 20 used.

The vertical reinforcement members 38 are longer than the height of the side walls 5, 6, such that the vertical reinforcement members 38 extend beyond the side walls 5, 6. In this manner the vertical reinforcement members 38 interconnect any successive foundation modules 1' formed thereon, as they extend vertically through the entire abutment 100. Each new foundation module 1 is essentially constructed in layers using the vertical reinforcement members 38 as a pair of shared supports.

In some embodiments more than two vertical reinforcement members 38 are used in each foundation module 1 to provide additional strength to the internal support 40.

A pair of horizontal reinforcement members 35 is then placed into the space 10 longitudinally i.e. parallel to the side walls and perpendicular to the brace 20. The horizontal reinforcement members 35 can be fixed to the brace 20 or to the vertical reinforcement members 38 or both. Alternatively the horizontal reinforcement members 35 can simply lie on the brace 20.

At this time additional struts 50 can be laid across the brace 20 longitudinally, to provide additional load bearing capacity to the finished module 1.

A successive pair of side walls 5', 6' are then respectively located on top of the side walls 5, 6 such that the upper flanges 7 of the side walls 5, 6 abut the lower flanges 8 of the side walls 5', 6'. The side walls 5, 6, 5', 6' can be bolted or welded to one another. Alternatively, a successive brace 20' is engaged with the abutting flanges of the side walls 5, 6, 5', 6' thereby joining side walls 5, 5' to the brace 20 at a first end of the brace and joining side walls 6, 6' to an opposing end of the brace 20.

The successive brace 20' can comprise holes 24 or slots to receive and/or locate the brace 20 with the two vertical reinforcement members 38, adding a second layer of foundation module 1' vertically aligned with module 1. This method can be repeated to keep engaging successive side walls and successive braces with the two vertical reinforcement members 38 until the desired height of abutment 100 is created.

The bridge 90 comprises an outer tray 92 which defines a cavity 71 having a reinforcement truss 91 supported therein. The bridge end to be supported by the abutment 100 is placed upon the seat 93 of the abutment. Secondly, and optionally, a corner connector 95 can be welded, bolted or otherwise secured to a portion (A, B, C) of the abutment 100 and to the reinforcement truss 91 of the bridge 90.

The settable material 15 is then added to the space 10 and the cavity 71 simultaneously in a pourable form, such that it engulfs the internal support 40 and flows around the space 10 and further fills the tray 92 flowing around the reinforcement truss 91 of the bridge 90.

As the settable material 15 sets, the side walls 5, 6, 5', 6', the braces 20, 20' and the horizontal reinforcement members 35, 35' and vertical reinforcement members 38 (the internal support 40) will be joined and integrated with the settable material 15 to form the abutment 100; furthermore, the reinforcement truss 91 will become integrated with tray 92 to form the deck 94 of the bridge 90; whereby both abutment 100 and bridge 90 are combined to form a unitary structure 110.

The solid in-situ connection between the bridge 90 and the abutment 100 eliminates the requirement of deck tie downs for the bridge 90, and provides resistance that is transferred into the foundations for breaking inertia and forces that the bridge may be subjected to.

The formwork 4 and reinforcement cage 30 are designed to be constructed in a factory in a modular fashion. As such, all the components are designed to be assembled in layers starting from the brace 20. As such, the foundation modules 1 are standardised, pre-engineered and pre-certified, and can be mass-produced off-site. They can then be transported easily in relatively flat packaging, and stored in a depot for rapid deployment to maintain efficient construction timelines, and for emergencies. The product is designed to use locally available resources such as lightweight cranes and easily-available concrete (N40 strength). The foundation modules 1 thus provide both structural and logistical advantages.

Manufacturing the standardised components of the abutment 100 in a factory facilitates mass-production using modular techniques, leading to high levels of quality control, reduced assembly costs, improved workplace safety, and the ability to pre-certify the engineered components.

The formwork 4 and reinforcements 35, 38 are designed to be stacked, making transport and storage easier and more cost-effective.

Concrete for the abutment 100 is added in a single pour, creating one homogeneous slab and eliminating longitudinal joins across the length and/or the width of the abutment 100. This has major structural advantages and increases confidence in the abutment durability and lifespan. For example, it eliminates longitudinal joints, particularly undesirable 'dry joints' which occur when filling in the gaps between precast panels with wet concrete; and the single large mass of concrete can better resist large loads.

Figure 27:
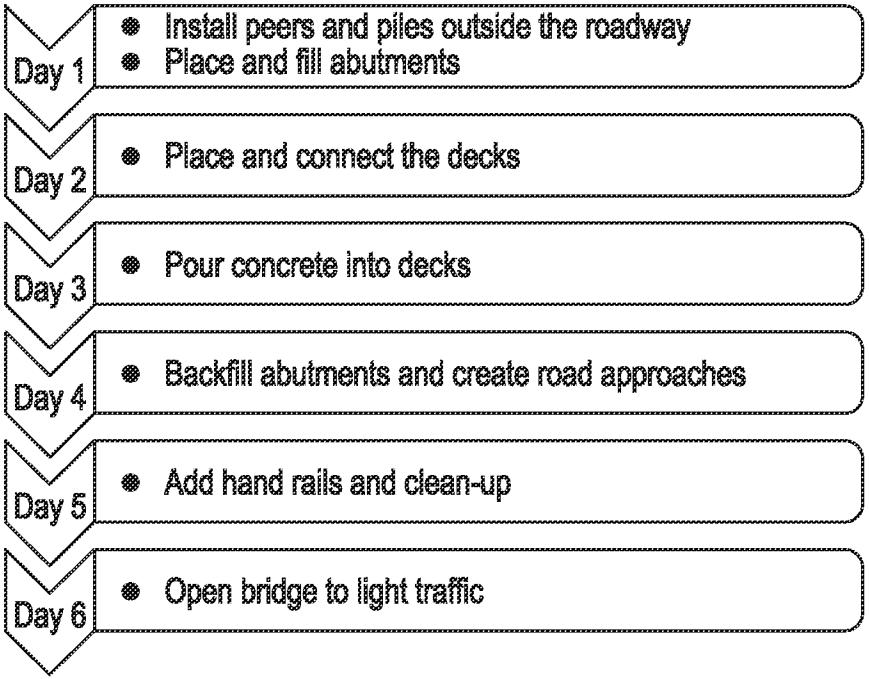
FIG. 27 is a flow chart defining a series of method steps for constructing a bridge using an abutment as described herein.

In this manner construction of the abutment 100 maintains many of the benefits of precast construction with the additional advantages of off-site manufacturing, standardisation, quality control and time savings, while reducing the transportation and cost limitations inherent to the precast method. It also eliminates the possibility of fracturel cracking of the concrete during transport, which is a serious risk for precast panels.

Where bridges are in need of maintenance or replacement it is often the case, that the bridge provides an invaluable link in the road network, hence the delay in attending to the necessary maintenance. Accordingly, there is a long felt need for a process of installing a replacement bridge in a short period of time to minimise the impact on the community of the bridge being out of action. FIG. 27 illustrates a method and timeline for the installation of a bridge using an abutment 100 as described herein.

On a first day, the piers 96 can be installed in preparation for the replacement bridge 90. Where possible, these piers 96 are installed outside of the normal road way to allow continued access to the old bridge to be replaced. Once the piers 96 are placed the abutment are placed in situ and filed with fluid concrete. At this time access to the old bridge is lost. The abutments 100 can be preassembled while the bridge is active, and moved into location at the latest possible time to maintain access to the old bridge.

Overnight the fluid concrete begins to cure and will reach a sufficient strength to receive the deck 94 on the second day. By day three the abutment 100 has cured further and the deck 94 is ready to receive a fluid concrete mixture. On day four the abutments can be back filled to level the deck 94 and the abutment 100 in preparation for creating the road 98 approaching the bridge 90.

With the heavier work completed and the combined structure curing, day 5 provide a sufficiently strong structure 110 to receive hand rails and clean-up the surrounding area. This can involve the removal of portions of the old bridge. By the sixth day the new bridge 90 and abutment 100 are ready to received light traffic. 40 MPa concrete will take seven days to reach 70% strength so the bridge 90 is not ready for a full load on day 6, but access over the new bridge 90 can be provided in a mere 6 days.

The 40 MPa concrete is surrounded by the side walls 5, 6 while curing and this traps moisture within the bridge and the abutment. The increased moisture levels around the concrete can slow down the curing process and may result in a stronger cured concrete.

In some situations a replacement bridge may be required near mud flats or swampy ground and the surrounding area to the bridge is not sufficiently strong to support a crane or similar construction equipment to build a new bridge. The cost of constructing a suitably strong foundation to enable the construction of a replacement bridge 90 can add hundreds of thousands of dollars to the overall cost of the bridge installation. With this situation in mind, the following method was conceived to work around or at least partially alleviate this issue.

There are four primary steps to the inaccessible bridge replacement method, illustrated in each of FIGS. 28A to 28D. A first abutment is constructed using new piers 96 at an end of the bridge 90 that remains accessible. The first abutment is used to support the loads of the new replacement bridge 90 being placed into position. The bridge 90 is installed in accordance with the method described above.

Once the bridge deck 94 is installed, the deck 94 can be used to access a previously inaccessible side of the bridge 90. The abutment 100 for the previously inaccessible side of the bridge 90 can be transported across the bridge 90 and into location on the previously inaccessible side of the ridge 90. A portion of the abutment 100 is not side walled, providing access to an exposed reinforcement portion 48 of the reinforcement cage 30 therein. The exposed portion 48 comprises first and second reinforcement members 38, 38a and/or struts 50 and braces 20 that are partially integrated into the finished, cured, abutment 100, illustrated in FIG. 28A.

Figure 28A:
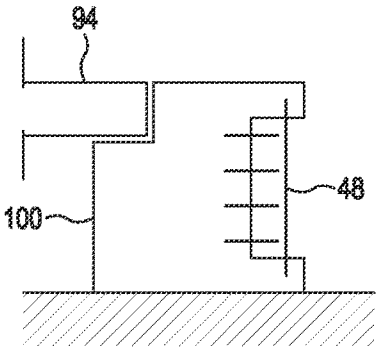
FIGS. 28A to 28D are schematic illustrations of four method steps for constructing a bridge using the abutment described herein, wherein access for driving piles into a foundation is not accessible on both sides of the bridge prior to the installation of the bridge.
Figure 28B:
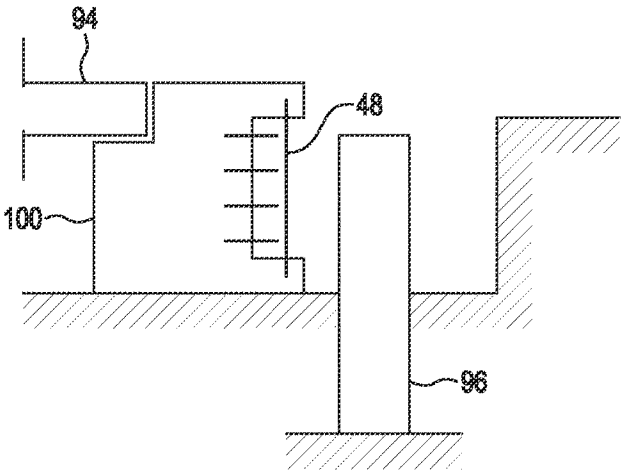
Figure 28C:
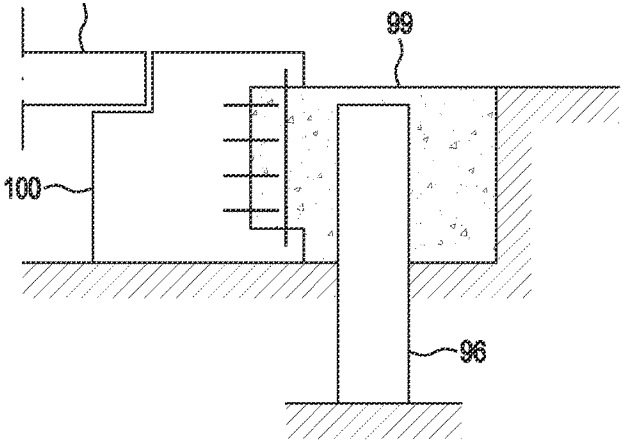

Once the abutment 100 is sufficiently cured to take the required load, the machinery and equipment required to drive and install the piers 96 can traverse the bridge deck 94 to provide access to the previously inaccessible side of the bridge 90, see FIG. 28B.

Once the pier 96 is in position, the cavity surrounding the pier 96 and the abutment 100 is filled with liquid concrete. The liquid concrete surrounds the exposed reinforcement portion 48 and as the liquid concrete cures, the pier 96 and exposed reinforcement 48 are integrated into a concrete slab 99 together. This slab 99 then ties the pier 96 to the abutment 100 and the reinforcement cage 30 therein, see FIG. 28C.

Figure 28D:
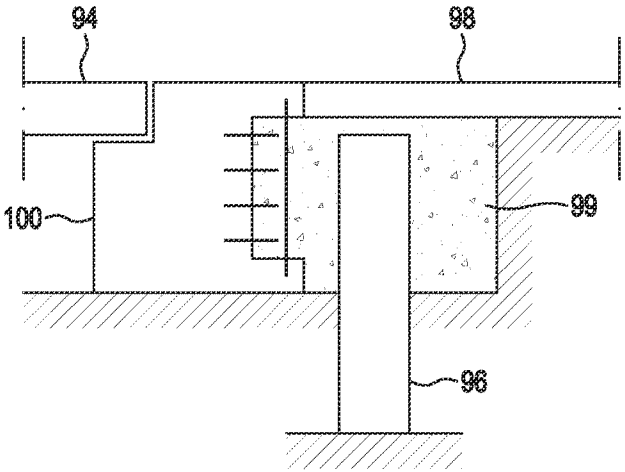

FIG. 28D illustrates the final stage in the process, whereby the road approach 98 is poured on top of the cured slab 99 encasing the pier 96, to provide access to the bridge 90 from the previously inaccessible end thereof. Constructing the structure 110 of the integrated bridge 90 and abutment 100 in this manner eliminates, if not significantly reduces, the requirement for strengthening or creating a new foundation around the old bridge to support the required construction machinery.

The above method provides opportunities for time savings and cost savings in the bridge replacement works. There is also a reduction in the impact on the surrounding environment to the bridge 90 without the need to construct artificial crane pads and graveling to reinforce the existing bridge foundation. The structure 110 is a self-contained unit and reacts the loads thereon within the modular structure 110, this has the potential to reduce the environmental impact of the replacement bridge 90.

The modules 1 use pre-certified designs, reducing the need for on-site engineers. Additionally, the reduction in on-site skills required makes it easier to source the required labour locally. This abutment method is particularly attractive for remote areas, such as mines, where transporting precast abutment panels is not a viable or economical option, and there are limited skilled resources for in situ construction.

Standardisation reduces design replication, and provides a flexibility and versatility in applying the modules to a variety of different applications.

When compared to precast construction techniques, any additional costs incurred from on-site concrete placement/finishing can be offset by the cost savings from installation of the modules, as the system does not require heavy lifting assembly and infill or stitching concrete sections. This provides further advantages in that less long-term maintenance is required on the abutments.

The abutment system is fully modular and can be assembled in many different formats for various design requirements. FIGS. 23-25 illustrate different formats of the abutment system having wing walls at 45, 67 and 90 degree angles from the primary wall. FIGS. 23A-25A illustrate the respective internal support structures within each of FIGS. 23-25. Gaps are illustrated in each of FIG. 23-25 merely to indicate that the abutment 100 can be extended across the gap i.e. the abutments of FIG. 23-25 can be higher, wider and longer that presently illustrated. The gaps in these Figures are not intended to represent a gap or break in the internal support structure 40, 40', 40" of these abutments 100, 100', 100".

It will be appreciated by persons skilled in the art that numerous variations and modifications may be made to the above-described embodiments, without departing from the scope of the following claims. The present embodiments are, therefore, to be considered in all respects as illustrative and not restrictive.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

LEGEND

| Ref# | Description |
|---|---|
| 1 | Foundation |
| | Module |
| 3 | Side wall web |
| 4 | Formwork |
| 5 | Side wall |
| 5a | Rounded edge |
| 6 | Side wall |
| 7 | Upper flange |
| 8 | Lower flange |
| 9 | C-channel |
| 10 | Space |
| 12 | Top surface |
| 14 | Flat brace |
| 15 | Settable material |
| 16 | $2^{nd}$ settable mat |
| 17 | Bolt |
| 19 | Sliding brace |
| 19a | Sliding brace end |
| 20 | Brace |
| 20a | Flared ends |
| 20b | Flared ends |

-continued

LEGEND

| Ref# | Description |
|---|---|
| 21 | Raised brace |
| 22 | Recessed brace |
| 23 | Recess |
| 24 | Holes |
| 25 | Protrusion/pin |
| 26 | Threaded end |
| 28 | Bottom sheet |
| 30 | Reinf cage |
| 35 | First reinf mbr |
| 38 | Second reinf mbr |
| 38a | Reduced Ø second reinf mbr |
| 40 | Internal support |
| 45 | Apertures |
| 46 | Extended side wall |
| 48 | Exposed reinf |
| 50 | Struts |
| 51 | Angled struts |
| 54 | Module top |
| 55 | Module base |
| 60 | End wall |
| 61 | End wall |
| 62 | End wall flange |
| 63 | End wall flange |
| 70 | Cavity |
| 71 | Bridge cavity |
| 72 | X-brace |
| 73 | U-brace |
| 74 | Ligatures |
| 75 | Tie-bar |
| 75 | Tie-bar-hooked |
| 80 | Primary wall |
| 81 | Central point |
| 85 | Wing wall |
| 86 | $1^{st}$ bridge reinf |
| 87 | $2^{nd}$ bridge reinf |
| 90 | Bridge |
| 90a | Ends of bridge |
| 90b | Ends of bridge |
| 91 | Reinf truss |
| 92 | Bridge tray |
| 93 | Seat |
| 94 | Deck |
| 95 | Corner connector |
| 96 | Pier |
| 97 | Headstock |
| 98 | Road |
| 99 | Pier slab |
| 100 | Abutment |
| 101 | $2^{nd}$ abutment |
| 103 | Flat surface |
| 110 | Structure |

What is claimed is:

1. A structure comprising a plurality of modules layered atop one another to provide a height to the structure, with each module comprising:

a plurality of formwork members, the formwork members of the plurality of modules together forming a pair of side walls that define a space therebetween containing a settable material, each of the plurality of formwork members configured as C-sections having a pair of boundary flanges and a central web extending therebetween; and a three-dimensional reinforcement cage disposed within and substantially conforming to the space and engaged with the pair of side walls, the reinforcement cage comprising:

(i) a plurality of braces that extend perpendicular to the pair of side walls locking the pair of side walls together in a spaced relationship and simultaneously interlocking adjacent formwork members to consolidate the formwork members of each of the plurality of modules;

(ii) a plurality of first members that extend between successive modules of the structure to thereby interlink the respective reinforcement cages thereof; and (iii) a plurality of second members that extend along a length of the structure parallel to the side walls, with the first members being coupled to the second members and the braces being coupled to at least one of the of the first members and the second members, wherein each of the plurality of braces comprise a pair of elongate protrusions and the boundary flanges of each formwork member include a series of apertures spaced along the boundary flanges for receiving the protrusions of the braces therein, wherein the respective reinforcement cages of each module provide support to locate and hold the side walls in the spaced relationship prior to the introduction of settable material into the space and during the setting thereof, and wherein the reinforcement cages of the respective modules are configured to, on the setting of the settable material, integrate with the pair of side walls thereby consolidating and providing internal support to the structure.

2. The structure of claim 1, further comprising a pair of end plates to enclose the space between the side walls of the respective modules and form a cavity therebetween.

3. The structure of claim 1, wherein the pair of elongate protrusions are located at opposing ends of each of the plurality of braces configured to mechanically attached engage with both a lower formwork member of a first module and an upper formwork member of an adjacent module to thereby align the modules within the structure.

4. The structure of claim 1, further comprising ligatures that encircle the interlinked reinforcement cages of the respective modules either horizontally or vertically within the space.

5. The structure of claim 1, further comprising a plurality of supplemental reinforcing members spaced between the respective pairs of side walls and extending along the length of each of the modules.

6. The structure of claim 1, further comprising a base extending between and coupled with a lower portion of the pair of side walls of a lowermost of the modules, wherein the base is configured with a recess thereby reducing a volume of the space.

7. The structure of claim 1, comprising a primary wall and at least one end wall, wherein the primary wall and each end wall each comprise at least two successively layered foundation modules and a reinforcement cage, wherein spaces of each wall are in fluid communication with each other such that introduction of the settable material thereto consolidates each wall together.

8. The structure of claim 7, wherein the reinforcement cage of the or each end wall is interconnected with the reinforcement cage of the primary wall.

9. The structure of claim 1, wherein the reinforcement cage of the upper one of the plurality of modules is configured to interlink with a reinforcement member of a further structure supported thereon, to provide load transfer therebetween.

10. The structure of claim 1, wherein the pair of elongate protrusions are threaded to receive a fastener.

11. A bridge structure that includes a consolidated abutment formed from the structure of claim 1, the abutment being formed simultaneously with a portion of a bridge supported upon a seat of the abutment.

12. A structure, comprising:

a plurality of formwork modules successively layered atop one another to provide a height to the structure, each formwork module comprising:

a plurality of formwork members, with the formwork members of the plurality of formwork modules together forming a pair of side walls that define a space therebetween for receiving a settable material, each of the plurality of formwork members configured as C-sections having a pair of boundary flanges and a central web extending therebetween; and a three-dimensional reinforcement cage disposed within and substantially conforming to the space and engaged with the pair of side walls, the reinforcement cage comprising:

(i) a plurality of braces that extend between the pair of side walls locking the pair of side walls together in a spaced relationship and simultaneously interlocking adjacent formwork members to consolidate the formwork members of each of the plurality of formwork modules;

(ii) a plurality of first members that extend between successive formwork modules of the structure; and (iii) a plurality of second members that extend along a length of the structure parallel to the sidewalls, with the first members being coupled to the second members, and the braces being coupled to at least one of the first members and the second members, wherein each of the plurality of braces comprise a pair of elongate protrusions and the boundary flanges of each formwork member include a series of apertures spaced along the boundary flanges for receiving the protrusions of the braces therein, wherein the reinforcement cage is configured to provide support to locate and hold the pair of side walls in the spaced relationship prior to introduction of the settable material into the space and during the setting thereof, and wherein the reinforcement cage is configured to integrate with the pair of side walls as the settable material sets consolidating and providing internal support to the structure.

13. The structure of claim 12, wherein the reinforcement cage is configured to interlink with a reinforcement member of a further structure supported thereon, to provide load transfer therebetween.

14. The structure of claim 12, wherein the pair of elongate protrusions are threaded to receive a fastener.

* * * * *